US011206897B2

(12) United States Patent
Bell et al.

(10) Patent No.: US 11,206,897 B2
(45) Date of Patent: Dec. 28, 2021

(54) GROUND-ENGAGING STRUCTURES FOR ARTICLES OF FOOTWEAR

(71) Applicant: NIKE, Inc., Beaverton, OR (US)

(72) Inventors: Thomas G. Bell, Portland, OR (US); Lysandre Follet, Portland, OR (US); John Hurd, Lake Oswego, OR (US); Troy C. Linder, Portland, OR (US); Geng Luo, Portland, OR (US); Adam Thuss, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 437 days.

(21) Appl. No.: 15/436,952

(22) Filed: Feb. 20, 2017

(65) Prior Publication Data

US 2017/0238656 A1 Aug. 24, 2017

Related U.S. Application Data

(60) Provisional application No. 62/298,613, filed on Feb. 23, 2016.

(51) Int. Cl.
*A43B 13/22* (2006.01)
*A43B 3/00* (2006.01)
(Continued)

(52) U.S. Cl.
CPC ..... *A43B 13/223* (2013.01); *A43B 3/0094* (2013.01); *A43B 5/001* (2013.01);
(Continued)

(58) Field of Classification Search
CPC ... A43B 13/223; A43B 13/146; A43B 13/184; A43B 13/122; A43B 3/0094; A43B 5/001; A43B 7/24
See application file for complete search history.

(56) References Cited

U.S. PATENT DOCUMENTS 124,127 A * 2/1872 Gibson, Jr. ..... A43C 15/161
36/59 R
3,626,611 A 12/1971 Louis
(Continued)

FOREIGN PATENT DOCUMENTS

CN 102631049 A 8/2012
FR 2770380 A1 5/1999
(Continued)

OTHER PUBLICATIONS

May 17, 2017—(WO) ISR & WO—App. No. PCT/US17/018914.
(Continued)

*Primary Examiner* — Jocelyn Bravo
(74) *Attorney, Agent, or Firm* — Banner & Witcoff, Ltd.

(57) ABSTRACT

Ground-engaging components for articles of footwear include: (a) an outer perimeter boundary rim at least partially defining an outer perimeter of the ground-engaging component and an open space at least at a forefoot support area, wherein the outer perimeter boundary rim defines an upper-facing surface and an opposite ground-facing surface; and (b) a forefoot edge support extending along and defining at least a portion of a first forefoot edge of the ground-engaging component. A bottom surface of the forefoot edge support (which may engage the ground) slants in an outward and downward direction from a location adjacent the open space toward the first forefoot edge. In some shoe pairs, the forefoot edge supports may be provided on a lateral forefoot side edge of one shoe, e.g., the right shoe, and on a medial forefoot side edge of the other shoe, e.g., the left shoe. The ground-engaging component(s) further may have "directional traction" features designed to support plant and rotation of the different feet when running a curve (e.g., on a curved or banked track).

18 Claims, 21 Drawing Sheets

(51) Int. Cl.

| | |
|---|---|
| ***A43B 5/00*** | (2006.01) |
| ***A43B 7/24*** | (2006.01) |
| ***A43B 13/14*** | (2006.01) |
| ***A43B 13/12*** | (2006.01) |
| ***A43B 13/18*** | (2006.01) |

(52) U.S. Cl.
CPC ..... *A43B 7/24* (2013.01); *A43B 13/122* (2013.01); *A43B 13/146* (2013.01); *A43B 13/184* (2013.01)

(56) References Cited

U.S. PATENT DOCUMENTS

| | | | | |
|---|---|---|---|---|
| 3,748,756 | A | 7/1973 | White | |
| 4,335,529 | A * | 6/1982 | Badalamenti | A43B 5/00 36/114 |
| 4,527,345 | A | 7/1985 | Lopez Lopez | |
| 4,559,724 | A | 12/1985 | Norton | |
| 4,624,062 | A * | 11/1986 | Autry | A43B 13/223 36/114 |
| 4,641,438 | A * | 2/1987 | Laird | A43B 13/223 36/32 R |
| 4,754,561 | A | 7/1988 | Dufour | |
| 4,790,083 | A * | 12/1988 | Dufour | A43B 5/001 36/127 |
| 4,837,949 | A * | 6/1989 | Dufour | A43B 5/001 36/114 |
| 5,265,354 | A * | 11/1993 | Aliano, Jr. | A43B 5/001 36/127 |
| 5,329,704 | A | 7/1994 | Martin, Jr. | |
| 5,384,973 | A | 1/1995 | Lyden | |
| 5,729,912 | A | 3/1998 | Gutkowski et al. | |
| 5,752,332 | A | 5/1998 | Kataoka et al. | |
| 5,875,569 | A * | 3/1999 | Dupree | A43B 13/143 36/103 |
| 6,108,943 | A * | 8/2000 | Hudson | A43B 5/10 36/102 |
| 6,158,151 | A | 12/2000 | Won | |
| 6,295,742 | B1 * | 10/2001 | Bathum | A43B 5/001 36/59 C |
| 6,321,468 | B1 * | 11/2001 | DeGrand | A43B 13/141 36/102 |
| 6,430,847 | B2 | 8/2002 | Fusco et al. | |
| 6,474,006 | B1 * | 11/2002 | Cummings | A43B 5/00 36/142 |
| 6,692,454 | B1 | 2/2004 | Townsend et al. | |
| 6,694,647 | B1 | 2/2004 | Patterson et al. | |
| 6,836,978 | B1 * | 1/2005 | Lauer | A43B 13/14 36/102 |
| 6,857,205 | B1 | 2/2005 | Fusco et al. | |
| 6,862,821 | B2 * | 3/2005 | Parisotto | A43B 5/002 36/30 R |
| 6,954,998 | B1 | 10/2005 | Lussier | |
| 7,254,905 | B2 | 8/2007 | Dennison | |
| 7,441,350 | B2 | 10/2008 | Auger et al. | |
| 7,533,476 | B2 | 5/2009 | Hay | |
| 7,634,861 | B2 | 12/2009 | Kilgore | |
| 7,832,117 | B2 | 11/2010 | Auger et al. | |
| 8,312,644 | B2 * | 11/2012 | Peikert | A43B 1/0045 36/30 R |
| 8,375,604 | B2 * | 2/2013 | Eder | A43B 13/26 36/114 |
| 8,776,403 | B2 * | 7/2014 | Eder | A43B 13/26 36/114 |
| 9,591,891 | B1 | 3/2017 | Baucom et al. | |
| 9,781,969 | B2 * | 10/2017 | Wright | A43B 13/14 |
| 2001/0007176 | A1 * | 7/2001 | Attilieni | A43B 7/08 36/3 B |
| 2001/0007181 | A1 | 7/2001 | Cagner | |
| 2002/0050077 | A1 * | 5/2002 | Wang | A43B 1/0072 36/28 |
| 2003/0154628 | A1 * | 8/2003 | Gyr | A43B 13/141 36/25 R |
| 2004/0111920 | A1 | 6/2004 | Cretinon | |
| 2006/0242863 | A1 * | 11/2006 | Patmore | A43B 13/26 36/127 |
| 2006/0277799 | A1 | 12/2006 | Lebo | |
| 2007/0068039 | A1 | 3/2007 | Nau | |
| 2007/0240333 | A1 | 10/2007 | Le et al. | |
| 2008/0216360 | A1 * | 9/2008 | Schenone | A43B 1/0072 36/30 R |
| 2008/0289220 | A1 | 11/2008 | Rivas et al. | |
| 2011/0088287 | A1 | 4/2011 | Auger et al. | |
| 2011/0247243 | A1 * | 10/2011 | Eder | A43B 13/26 36/67 A |
| 2011/0277351 | A1 | 11/2011 | Scoledes | |
| 2012/0260535 | A1 * | 10/2012 | Tsang | A43B 13/26 36/32 R |
| 2013/0067776 | A1 | 3/2013 | Auger et al. | |
| 2013/0139406 | A1 * | 6/2013 | Shiue | A43B 13/14 36/31 |
| 2013/0174444 | A1 | 7/2013 | Jacobs et al. | |
| 2013/0192092 | A1 * | 8/2013 | Eder | A43B 13/26 36/59 R |
| 2013/0326908 | A1 | 12/2013 | Grott et al. | |
| 2014/0123522 | A1 | 5/2014 | Rustam et al. | |
| 2014/0182169 | A1 | 7/2014 | Mack | |
| 2014/0196317 | A1 * | 7/2014 | Katz | A43C 11/1493 36/89 |
| 2014/0202042 | A1 | 7/2014 | Berend et al. | |
| 2014/0250723 | A1 | 9/2014 | Kohatsu | |
| 2014/0259744 | A1 | 9/2014 | Cooper | |
| 2014/0325871 | A1 * | 11/2014 | Price | A43B 13/18 36/28 |
| 2015/0096199 | A1 | 4/2015 | Cavaliere et al. | |
| 2015/0230546 | A1 * | 8/2015 | Zasloff | A43B 3/00 36/30 R |
| 2015/0282557 | A1 | 10/2015 | Kirk et al. | |
| 2015/0287557 | A1 | 10/2015 | Fukunaga | |
| 2016/0000185 | A1 | 1/2016 | Cook et al. | |
| 2016/0001478 | A1 | 1/2016 | Cook et al. | |
| 2016/0015120 | A1 | 1/2016 | Denison et al. | |
| 2016/0051011 | A1 | 2/2016 | Francis et al. | |
| 2016/0081425 | A1 | 3/2016 | Piontkowski et al. | |
| 2016/0174656 | A1 | 6/2016 | Wolfrom et al. | |
| 2016/0219973 | A1 | 8/2016 | Cheney et al. | |
| 2017/0042285 | A1 * | 2/2017 | Lawless | A43B 13/181 |
| 2017/0079373 | A1 | 3/2017 | Huard et al. | |
| 2017/0119091 | A1 | 5/2017 | Bischoff et al. | |
| 2017/0150782 | A1 | 6/2017 | Moriyasu et al. | |
| 2017/0188655 | A1 | 7/2017 | Carlson et al. | |

FOREIGN PATENT DOCUMENTS

| | | | |
|---|---|---|---|
| GB | 163236 | A | 5/1921 |
| GB | 326700 | A | 3/1930 |
| JP | S5485848 | A | 7/1979 |
| JP | 2005013365 | A | 1/2005 |
| WO | 2004041012 | A1 | 5/2004 |
| WO | 2006017200 | A2 | 2/2006 |
| WO | 2014066369 | A2 | 5/2014 |
| WO | 2015052813 | A1 | 4/2015 |
| WO | 2016004352 | A1 | 1/2016 |

OTHER PUBLICATIONS

"Anzen-tabi non slip sole work boots shoes for men mountain walking" Aug. 16, 2014 <http://www.alibaba.com/cache/Anzen-tabi-non-slip-sole-work_138059115.html>.

Logan, Suzanna, et al. "Ground reaction force differences between running shoes, racing flats, and distance spikes in runners." Journal of sports sciences medicine 9.1 (2010): 147 <https://www.ncbi.nlm.nih.gov/pmc/articles/PMC3737977/>.

Larson, Peter, et al. "Foot strike patterns of recreational and sub-elite runners in a long-distance road race" Journal of sports sciences 29.15 (2011): 1665-1673 <http://www.tandfonline.com/doi/abs/10.1080/02640414.2011.610347>.

Van Rens, B.J.E., et al. "Energy return in running surfaces" Eindhoven: Technische Universiteit Eindhoven. 46p (1994) <http://alexandria.tue.nl/repository/books/652989.pdf>.

(56) References Cited

OTHER PUBLICATIONS

Pang, Nick. "The Split-Toe Running Shoe: Topo Athletic RR Racing Shoe Reviewed." Natural Running Center, Jul. 21, 2013. <http://naturalrunningcenter.com/2013/07/21/topo-athletic-rr-racing-shoe-review/>.
Mar. 3, 20171—(WO) International Search Report and Written Opinion—App PCT/US2016/066816.

* cited by examiner

GROUND-ENGAGING STRUCTURES FOR ARTICLES OF FOOTWEAR

RELATED APPLICATION DATA

This application claims priority to U.S. Provisional Patent Application No. 62/298,613, titled "Ground-Engaging Structures for Articles of Footwear" and filed Feb. 23, 2016. U.S. Provisional Patent Application No. 62/298,613, in its entirety, is incorporated by reference herein. Each of U.S. Provisional Patent Application No. 62/165,659 filed May 22, 2015 and International Appln. PCT/US2016/033557 filed May 20, 2016, in its entirety, also is incorporated by reference herein.

FIELD OF THE INVENTION

The present invention relates to the field of footwear. More specifically, aspects of the present invention pertain to articles of athletic footwear and/or ground-engaging structures for articles of footwear, e.g., used in track and field events and/or short to middle distance running events (e.g., for 200 m, 400 m, 800 m, 1500 m, etc.) and/or track shoes for running races on a curved and/or banked track.

TERMINOLOGY/GENERAL INFORMATION

First, some general terminology and information is provided that will assist in understanding various portions of this specification and the invention(s) as described herein. As noted above, the present invention relates to the field of footwear. "Footwear" means any type of wearing apparel for the feet, and this term includes, but is not limited to: all types of shoes, boots, sneakers, sandals, thongs, flip-flops, mules, scuffs, slippers, sport-specific shoes (such as track shoes, golf shoes, tennis shoes, baseball cleats, soccer or football cleats, ski boots, basketball shoes, cross training shoes, etc.), and the like.

FIG. 1 also provides information that may be useful for explaining and understanding the specification and/or aspects of this invention. More specifically, FIG. 1 provides a representation of a footwear component 100, which in this illustrated example constitutes a portion of a sole structure for an article of footwear. The same general definitions and terminology described below may apply to footwear in general and/or to other footwear components or portions thereof, such as an upper, a midsole component, an outsole component, a ground-engaging component, etc.

First, as illustrated in FIG. 1, the terms "forward" or "forward direction" as used herein, unless otherwise noted or clear from the context, mean toward or in a direction toward a forward-most toe ("FT") area of the footwear structure or component 100. The terms "rearward" or "rearward direction" as used herein, unless otherwise noted or clear from the context, mean toward or in a direction toward a rear-most heel area ("RH") of the footwear structure or component 100. The terms "lateral" or "lateral side" as used herein, unless otherwise noted or clear from the context, mean the outside or "little toe" side of the footwear structure or component 100. The terms "medial" or "medial side" as used herein, unless otherwise noted or clear from the context, mean the inside or "big toe" side of the footwear structure or component 100.

Also, various example features and aspects of this invention may be disclosed or explained herein with reference to a "longitudinal direction" and/or with respect to a "longitudinal length" of a footwear component 100 (such as a footwear sole structure). As shown in FIG. 1, the "longitudinal direction" is determined as the direction of a line extending from a rear-most heel location (RH in FIG. 1) to the forward-most toe location (FT in FIG. 1) of the footwear component 100 in question (a sole structure or foot-supporting member in this illustrated example). The "longitudinal length" L is the length dimension measured from the rear-most heel location RH to the forward-most toe location FT. The rear-most heel location RH and the forward-most toe location FT may be located by determining the rear heel and forward toe tangent points with respect to front and back parallel vertical planes VP when the component 100 (e.g., sole structure or foot-supporting member in this illustrated example, optionally as part of an article of footwear or foot-receiving device) is oriented on a horizontal support surface S in an unloaded condition (e.g., with no weight or force applied to it other than potentially the weight/force of the shoe components with which it is engaged). If the forward-most and/or rear-most locations of a specific footwear component 100 constitute a line segment (rather than a tangent point), then the forward-most toe location and/or the rear-most heel location constitute the mid-point of the corresponding line segment. If the forward-most and/or rear-most locations of a specific footwear component 100 constitute two or more separated points or line segments, then the forward-most toe location and/or the rear-most heel location constitute the mid-point of a line segment connecting the furthest spaced and separated points and/or furthest spaced and separated end points of the line segments (irrespective of whether the midpoint itself lies on the component 100 structure). If the forward-most and/or rear-most locations constitute one or more areas, then the forward-most toe location and/or the rear-most heel location constitute the geographic center of the area or combined areas (irrespective of whether the geographic center itself lies on the component 100 structure).

Once the longitudinal direction of a component or structure 100 has been determined with the component 100 oriented on a horizontal support surface S in an unloaded condition, planes may be oriented perpendicular to this longitudinal direction (e.g., planes running into and out of the page of FIG. 1). The locations of these perpendicular planes may be specified based on their positions along the longitudinal length L where the perpendicular plane intersects the longitudinal direction between the rear-most heel location RH and the forward-most toe location FT. In this illustrated example of FIG. 1, the rear-most heel location RH is considered as the origin for measurements (or the "0L position") and the forward-most toe location FT is considered the end of the longitudinal length of this component (or the "1.0L position"). Plane position may be specified based on its location along the longitudinal length L (between 0L and 1.0L), measured forward from the rear-most heel RH location in this example. FIG. 1 shows locations of various planes perpendicular to the longitudinal direction (and oriented in the transverse direction) and located along the longitudinal length L at positions 0.25L, 0.4L, 0.5L, 0.55L, 0.6L, and 0.8L (measured in a forward direction from the rear-most heel location RH). These planes may extend into and out of the page of the paper from the view shown in FIG. 1, and similar planes may be oriented at any other desired positions along the longitudinal length L. While these planes may be parallel to the parallel vertical planes VP used to determine the rear-most heel RH and forward-most toe FT locations, this is not a requirement. Rather, the orientations of the perpendicular planes along the longitudinal length L will depend on the orientation of the longitudinal direction, which may or may not be parallel to the horizontal surface S and/or perpendicular to the vertical planes VP in the arrangement/orientation shown in FIG. 1.

BRIEF DESCRIPTION OF THE DRAWINGS

The following Detailed Description will be better understood when read in conjunction with the accompanying drawings in which like reference numerals refer to the same or similar elements in all of the various views in which that reference number appears.

Figure 1:
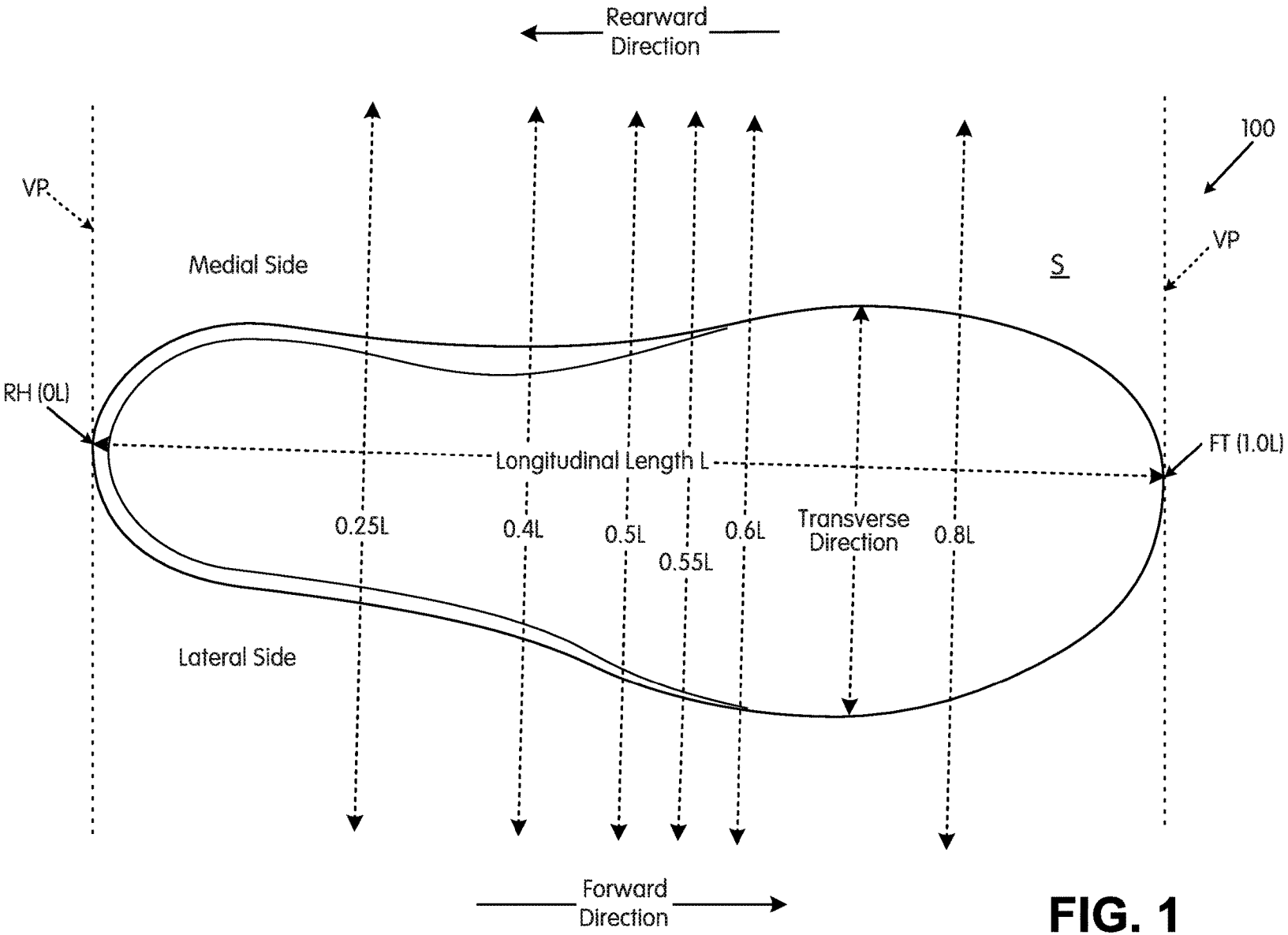
FIG. 1 is provided to help illustrate and explain background and definitional information useful for understanding certain terminology and aspects of this invention.

The reader should understand that the attached drawings are not necessarily drawn to scale.

DETAILED DESCRIPTION

In the following description of various examples of footwear structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and functions without departing from the scope of the present invention.

While potentially useful for any desired types or styles of shoes, aspects of this invention may be of particular interest for athletic shoes, including track shoes or shoes for short to middle distance runs (e.g., for 200 m, 400 m, 800 m, 1500 m, etc.), e.g., events run on a curved and/or banked track.

Some aspects of this invention relate to ground-engaging components for articles of footwear that include: (a) an outer perimeter boundary rim (e.g., at least 3 mm wide (0.12 inches) or 4 mm wide (0.16 inches)) that at least partially defines an outer perimeter of the ground-engaging component (e.g., the outer perimeter boundary rim may be present around at least 60%, at least 80% or at least 90% of the outer perimeter of the ground-engaging component), wherein the outer perimeter boundary rim defines an upper-facing surface and a ground-facing surface opposite the upper-facing surface, wherein the outer perimeter boundary rim defines an open space at least at a forefoot support area of the ground-engaging component (and optionally over the arch support and/or heel support areas as well); and (b) a matrix structure (also called a "support structure" herein) extending from the outer perimeter boundary rim (e.g., from the ground-facing surface and/or upper-facing surface) and at least partially across the open space at least at the forefoot support area to define an open cellular construction with plural open cells across the open space at least at the forefoot support area, wherein a plurality (e.g., at least a majority (and in some examples, at least 55%, at least 60%, at least 70%, at least 80%, at least 90%, or even at least 95%)) of the open cells of the open cellular construction have curved perimeters with no distinct corners (particularly when viewed from the upper-facing surface).

In at least some example structures in accordance with aspects of this invention, the matrix structure further may define one or more partially open cells located within the open space and/or one or more closed cells (e.g., at the ground-facing surface of the outer perimeter boundary rim). The open space and/or the matrix structure may extend to all areas of the ground-engaging component inside its outer perimeter boundary rim (e.g., from front toe to rear heel, from medial side edge to lateral side edge, etc.). Furthermore, the matrix structure in at least some ground-engaging components in accordance with this invention will define secondary traction elements, e.g., at corners defined by the matrix structure around the open cells, partially open cells, and/or closed cells.

Additionally or alternatively, if desired, the matrix structure may define one or more cleat support areas for engaging or supporting primary traction elements, such as track spikes or other cleat elements (e.g., permanently fixed cleats or track spikes, removable cleats or track spikes, etc.). The cleat support area(s) may be located: (a) within the outer perimeter boundary rim (e.g., on its ground-facing surface), (b) at least partially within the outer perimeter boundary rim (e.g., at least partially within its ground-facing surface), (c) within the open space, (d) extending from the outer perimeter boundary rim into and/or across the open space, and/or (e) between a lateral side of the outer perimeter boundary rim and a medial side of the outer perimeter boundary rim. The matrix structure further may define a plurality of secondary traction elements at various locations, e.g., dispersed around one or more of any present cleat support areas; between open and/or partially open cells of the matrix structure; at the outer perimeter boundary rim; at "corners" of the matrix structure; etc. As some more specific examples, the matrix structure may define at least four secondary traction elements dispersed around at least some individual open cells of the open cellular construction that have the curved perimeters with no distinct corners, and optionally, six secondary traction elements may be disposed around at least some of the individual open cells of the open cellular construction that have the curved perimeters with no distinct corners (e.g., in a generally hexagonal arrangement of secondary traction elements). At least some of the plurality of individual open cells that include secondary traction elements dispersed around them may be located at a medial forefoot support area, a central forefoot support area, a lateral forefoot support area, a first metatarsal head support area, a forward toe support area, and/or a heel area of the ground-engaging component.

While primary traction elements may be provided at any desired locations on ground-engaging components in accordance with this invention, in some example structures the cleat support areas for primary traction elements will be provided at least at two or more of the following: (a) a first cleat support area (and optionally with an associated primary traction element) at or at least partially in a lateral side of the ground-facing surface of the outer perimeter boundary rim; (b) a second cleat support area (and optionally with an associated primary traction element) at or at least partially in a medial side of the ground-facing surface of the outer perimeter boundary rim; (c) a third cleat support area (and optionally with an associated primary traction element) at or at least partially in a medial side of the ground-facing surface of the outer perimeter boundary rim and located forward of the second cleat support area; and/or (d) a fourth cleat support area (and optionally with an associated primary traction element) at or at least partially in the ground-facing surface of the outer perimeter boundary rim and located forward of at least one of the second or third cleat support areas. All of these four cleat support areas (and/or any associated primary traction element) may be located forward of a perpendicular plane oriented at 0.55L of the ground-engaging component and/or the sole structure. Although some ground-engaging components according to some aspects of this invention will include only these four cleat support areas (and associated primary traction elements), more or fewer cleat support areas (and primary traction elements associated therewith) may be provided, if desired.

The matrix structure in accordance with at least some examples of this invention may include at least one set of open and/or partially open cells, wherein geographical centers of at least three cells of this first set of "at least partially open cells" are "substantially aligned" or "highly substantially aligned" (the term "at least partially open cells" means one or more of partially open cells and/or open cells, which terms will be explained in more detail below). Optionally, the geographic centers of at least three cells (and in some examples, at least four cells or even at least six cells) of this first set will be "substantially aligned" or "highly substantially aligned," optionally in the forefoot support area, along a line that extends from a rear lateral direction toward a forward medial direction of the ground-engaging component and/or the article of footwear in which it may be contained. Open or partially open cells are considered to be "substantially aligned," as that term is used herein in this context, if the geographical centers of each of the cells in question lie on a straight line and/or within a distance of 10 mm (0.39 inches) from a straight line. "Highly substantially aligned" cells each have their geographic centers lying on a straight line and/or within a distance of 5 mm (0.2 inches) from a straight line. Matrix structures in accordance with at least some examples of this invention may include two or more sets of open and/or partially open cells, wherein geographical centers of at least three cells within the respective sets are substantially aligned or highly substantially aligned with a straight line for that set (and optionally substantially aligned or highly substantially aligned with a straight line that extends from the rear lateral direction toward the forward medial direction of the ground-engaging component and/or sole structure). Some matrix structures in accordance with this invention may include from 2 to 20 sets of substantially aligned cells and/or highly substantially aligned cells, or even from 3-15 sets of substantially aligned cells and/or highly substantially aligned cells. When multiple sets of substantially aligned cells and/or highly substantially aligned cells are present in a matrix structure, the aligned and/or highly aligned sets of cells may be separated from one another along the front-to-back and/or longitudinal direction of the ground-engaging component and/or sole structure.

Additional aspects of this invention relate to sizes and relative sizes of cells within the support/matrix structure. In general, smaller cells sizes typically will result in more support, more stiffness, and less flexibility than larger cell sizes (e.g., assuming common materials, thicknesses, and/or structures). In at least some examples of this invention, an average open cell size defined by the matrix structure on a medial forefoot side support area (and/or on a medial side of a front-to-rear center line) of the ground-engaging component will be smaller than an average open cell size defined by the matrix structure on a lateral forefoot side support area (and/or on a lateral side of the front-to-rear center line) of the ground-engaging component. As another example, an average open cell size defined by the matrix structure in a first metatarsal head support area ("big toe" side support area) of the ground-engaging component will be smaller than an average open cell size defined by the matrix structure in a fourth and/or fifth metatarsal head support area ("little toe" side support area) of the ground-engaging component.

As some additional potential features, in the arch support area and/or the forefoot support area, the matrix structure may define a first open cell and an adjacent second open cell, wherein the first open cell has a cross sectional area (e.g., area of the opening) of less than 50% (and in some examples, less than 40%, less than 30%, or even less than 25%) of a cross sectional area (e.g., area of the opening) of the second open cell, and wherein a geographic center of the first open cell is located closer to the medial side edge of the ground-engaging component than is a geographic center of the second open cell. A cell is "adjacent" to another cell if a straight line can be drawn to connect openings of the two cells without that straight line crossing through the open space of another cell and/or passing between two other adjacent cells and/or if the two cells share a wall. "Adjacent cells" also may be located close to one another (e.g., so that a straight line distance between the openings of cells is less than 1 inch (2.54 cm) long (and in some examples, less than 0.5 inches long (1.27 cm), or even less than 0.25 (0.64 cm) inches long)). In these arrangements, the second open cell (the cell further from the medial side) may be elongated in a medial side-to-lateral side direction and/or the first open cell (the cell closer to the medial side) may be elongated in a front-to-rear direction.

In the forefoot support area, such a matrix structure may further define a first open cell, an adjacent second open cell, and an adjacent third open cell, wherein the first open cell has a cross sectional area (e.g., area of the opening) of less than 50% of a cross sectional area (e.g., area of the opening) of the second open cell and/or of less than 50% of a cross sectional area (e.g., area of the opening) of the third open cell. In such an arrangement, a geographic center of the first open cell may be located: (a) closer to the medial side edge than is a geographic center of the second open cell and/or (b) closer to the medial side edge than is a geographic center of the third open cell. If desired, the first open cell may be elongated in a front-to-rear direction.

The forefoot area of some example matrix structures in accordance with this invention further may define a fourth open cell that is adjacent to the third open cell and adjacent a fifth open cell, wherein the fourth open cell has a cross sectional area (e.g., area of the opening) of less than 50% of the cross sectional area (e.g., area of the opening) of the third open cell and/or of less than 50% of a cross sectional area (e.g., area of the opening) of the fifth open cell. In this arrangement, a geographic center of the fourth open cell may be located: (a) closer to the medial side edge than is the geographic center of the third open cell and/or (b) closer to the medial side edge than is a geographic center of the fifth open cell.

As other options, the forefoot area of such a matrix structure further may include a fourth open cell that is adjacent to a fifth open cell and a sixth open cell, wherein the fourth open cell has a cross sectional area (e.g., area of the opening) of less than 50% of the cross sectional area (e.g., area of the opening) of the fifth open cell and/or of less than 50% of a cross sectional area (e.g., area of the opening) of the sixth open cell. In this arrangement, a geographic center of the fourth open cell may be located: (a) closer to the medial side edge than is the geographic center of the fifth open cell and/or (b) closer to the medial side edge than is a geographic center of the sixth open cell. If desired, in this arrangement, the first open cell (described above) may be separated from the fourth open cell by a seventh open cell, and this seventh open cell may be located adjacent to the third open cell and the fifth open cell. Also, if desired, this seventh open cell may have a cross sectional area (e.g., area of the opening) of less than 50% of the cross sectional area (e.g., area of the opening) of the third open cell and/or of less than 50% of a cross sectional area (e.g., area of the opening) of the fifth open cell, and wherein a geographic center of the seventh open cell is located: (a) closer to the medial side edge than is the geographic center of the third open cell and/or (b) closer to the medial side edge than is the geographic center of the fifth open cell.

Additional aspects of this invention relate to ground-engaging components for articles of footwear that include: (a) a foot support member that defines an upper-facing surface and a ground-facing surface opposite the upper-facing surface; and (b) a forefoot edge support engaged with or integrally formed with the foot support member. The forefoot edge support may extend along and define at least a portion of a first forefoot edge of the ground-engaging component, and an outward slanted bottom surface of the forefoot edge support may originate within 2 inches (5.1 cm) of the first forefoot edge and slant in an outward and downward direction from its origin toward the first forefoot edge. In some examples of this invention, the forefoot edge support may originate within 1.75 inches (4.45 cm) and/or within 1.5 inches (3.81 cm) of the first forefoot edge (e.g., measured in the transverse direction at a widest transverse width dimension of the forefoot edge support).

Still additional aspects of this invention relate to ground-engaging components for articles of footwear that include: (a) an outer perimeter boundary rim that at least partially defines an outer perimeter of the ground-engaging component, wherein the outer perimeter boundary rim defines an upper-facing surface and a ground-facing surface opposite the upper-facing surface, and wherein the outer perimeter boundary rim defines an open space at least at a forefoot support area of the ground-engaging component; and (b) a forefoot edge support extending along and defining at least a portion of a first forefoot edge of the ground-engaging component, wherein a bottom surface of the forefoot edge support (which may constitute a bottom, ground-contacting surface of the ground-engaging component) slants in an outward and downward direction from a location adjacent the open space toward and to a location at or adjacent the first forefoot edge. In at least some pairs of sole structures and/or shoes containing the sole structures, the forefoot edge support may be provided on a lateral forefoot side edge of the ground-engaging component (e.g., for a right shoe), and optionally only on the lateral forefoot side edge of that shoe, and/or the forefoot edge support may be provided on a medial forefoot side edge of the ground-engaging component (e.g., for a left shoe), and optionally only on the medial forefoot side edge of that shoe. The forefoot edge support may extend from, be engaged with, or be integrally formed with the outer perimeter boundary rim and/or a support structure provided in the open space (e.g., a matrix support structure).

The ground-engaging components according to this aspect of the invention may have any of the various features, properties, attributes, and/or options described above (e.g., including the matrix features; the open cell/open cellular construction features; the curved open cell perimeter features; the cleat support area features; the secondary traction element features; the average and/or relative open cell size features; the open cell orientation, alignment, shape, and/or positioning features; the outer perimeter size features and/or locational features; etc.).

In at least some examples of this aspect of the invention, the forefoot edge support may extend downward from the ground-facing surface of the outer perimeter boundary rim. As some more specific examples, the outer perimeter boundary rim may define an exterior perimeter edge and an interior perimeter edge, and the forefoot edge support may originate and/or extend from the open space defined by the outer perimeter boundary rim, e.g., from a location inside the interior perimeter edge of the outer perimeter boundary rim. The forefoot edge support may extend outward beyond the exterior perimeter edge of the outer perimeter boundary rim and/or downward below the ground-facing surface of the outer perimeter boundary rim. The forefoot edge support may terminate at one end, e.g., at a forward toe location and/or at its other end, e.g., at an arch support area. Each shoe may include a single forefoot edge support of this type, optionally only along one forefoot edge per sole structure (e.g., on the medial forefoot edge of the left shoe and the lateral forefoot edge of the right shoe).

If desired, e.g., to promote better flexibility and/or natural motion characteristics, the forefoot edge support may include a plurality of edge support components that define a free outer edge of the forefoot edge support. At least some (and optionally all) of these edge support components may extend from (and be interconnected at) a base area (e.g., located at or near the outer perimeter boundary rim) to the free outer edge. At the free outer edge, at least some of the plurality of edge support components may be separated from at least one respective adjacent edge support component by a gap of less than 12 mm (0.48 inch), less than 10 mm (0.39 inch), less than 8 mm (0.32 inch), less than 5 mm (0.20 inch), and in some examples, by a gap of less than 3 mm (0.12 inch).

Additional aspects of this invention relate to ground-engaging components that include "directional traction" features that facilitate and better support running around a curve (e.g., a curved (and optionally banked) track). When running a curved track, the runner's inside foot (e.g., left foot when running counter-clockwise) typically is the steering foot and the outside foot (e.g., the right foot when running counter-clockwise) is the driving foot. Forces do not act on these two feet in the same manner when running the curve. For example, the inside foot typically changes direction relatively early in the step cycle such that stance and rotation occur off the medial, ball of the foot area (e.g., near the first metatarsal head area). Therefore, in accordance with at least some examples of this invention, the ground-engaging component supporting the inside foot includes a single, medial side primary traction element at the medial, ball of the foot area (with other forefoot based primary traction elements provided well forward, e.g., for the toe-off phase of the step cycle), and cells of the ground-engaging component's matrix structure and/or secondary traction elements may be arranged along arcs around this medial, ball of the foot arranged primary traction element. For the outside foot, however, direction change occurs later in the step cycle (e.g., at the terminal stance and/or toe-off phase) such that stance and rotation occur off a medial, forefoot area (e.g., beneath the runner's "big toe"). Therefore, in accordance with at least some examples of this invention, the ground-engaging component supporting the outside foot includes a single, extreme forefoot primary traction element at the medial, toe area (with other forefoot based primary traction elements provided well rearward), and cells of the ground-engaging component's matrix structure and/or secondary traction elements may be arranged along arcs around this extreme forefoot primary element. These different arrangements and orientations of primary traction elements, matrix cells, and secondary traction elements in the right and left ground-engaging component structures help facilitate and support the different rotations and forces applied to the shoe when running a curve (e.g., on a curved or banked track).

Additional aspects of this invention relate to articles of footwear that include an upper and a sole structure engaged with the upper. The sole structure will include a ground-engaging component having any one or more of the features described above and/or any combinations of features described above. The sole structures on a pair of shoes need not be mirror images of one another. The upper may be made from any desired upper materials and/or upper constructions, including upper materials and/or upper constructions as are conventionally known and used in the footwear art (e.g., especially upper materials and/or constructions used in track shoes or shoes for short and/or middle distance runs (e.g., for 200 m, 400 m, 800 m, 1500 m, etc.)). As some more specific examples, at least a portion (or even a majority, all, or substantially all) of the upper may include a woven textile component and/or a knitted textile component (and/or other lightweight constructions).

Articles of footwear in accordance with at least some examples of this invention will not include an external midsole component (e.g., located outside of the upper). Rather, in at least some examples of this invention, the sole structure will consist essentially of the ground-engaging component, and the article of footwear will consist essentially of an upper (and its one or more component parts, including any laces or other securing system components and/or an interior insole or sock liner component) with the ground-engaging component engaged with it. Some articles of footwear according to aspects of this invention will include the upper-facing surface of the ground-engaging support component directly engaged with the upper (e.g., with a bottom surface of the upper and/or a strobel component). Optionally, the bottom surface of the upper (e.g., a strobel or other bottom upper component) may include a component with desired colors or other graphics to be displayed through the open cells of the matrix structure.

If desired, in accordance with at least some examples of this invention, at least some portion(s) of a bottom surface of the upper (e.g., the strobel) may be exposed at an exterior of the shoe structure. As some more specific examples, the bottom surface of the upper may be exposed: (a) in the open space of the ground-engaging component (e.g., at least in the forefoot support area through open cells and/or partially open cells in any present matrix structure, etc.); (b) in the arch support area of the sole structure (e.g., through open cells and/or partially open cells in any present matrix structure, etc.); and/or (c) in the heel support area of the sole structure (e.g., through open cells and/or partially open cells in any present matrix structure, etc.).

Additional aspects of this invention relate to methods of making ground-engaging support components, sole structures, and/or articles of footwear of the various types and structures described above.

More specific examples of structures and aspects of this invention now will be described with reference to the accompanying figures.

Figure 2A:
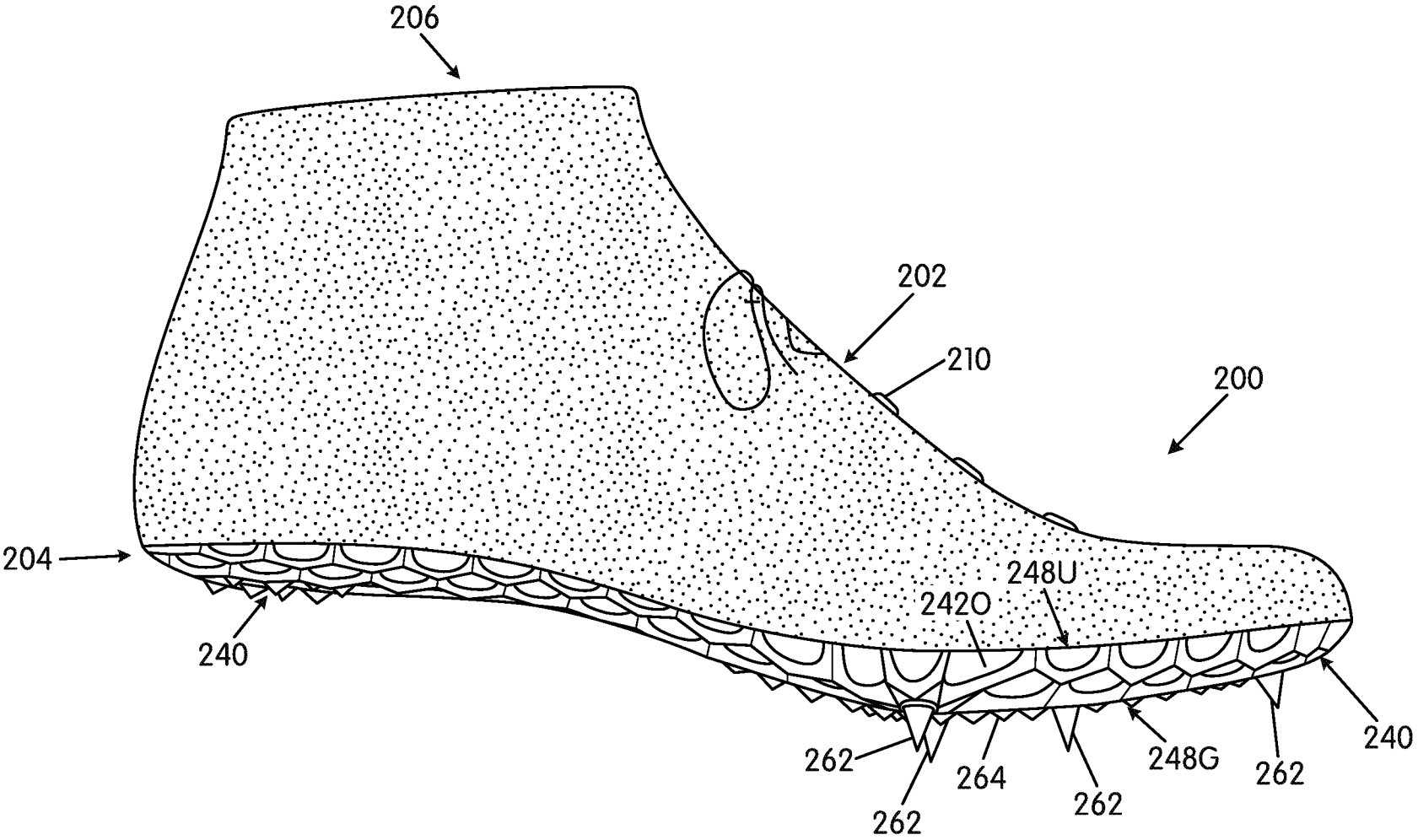
FIGS. 2A-2D provide a lateral side view, a bottom view, an enlarged bottom view around a cleat mount area, and an enlarged perspective view around a cleat mount area, respectively, of an article of footwear in accordance with at least some aspects of this invention.
Figure 2B:
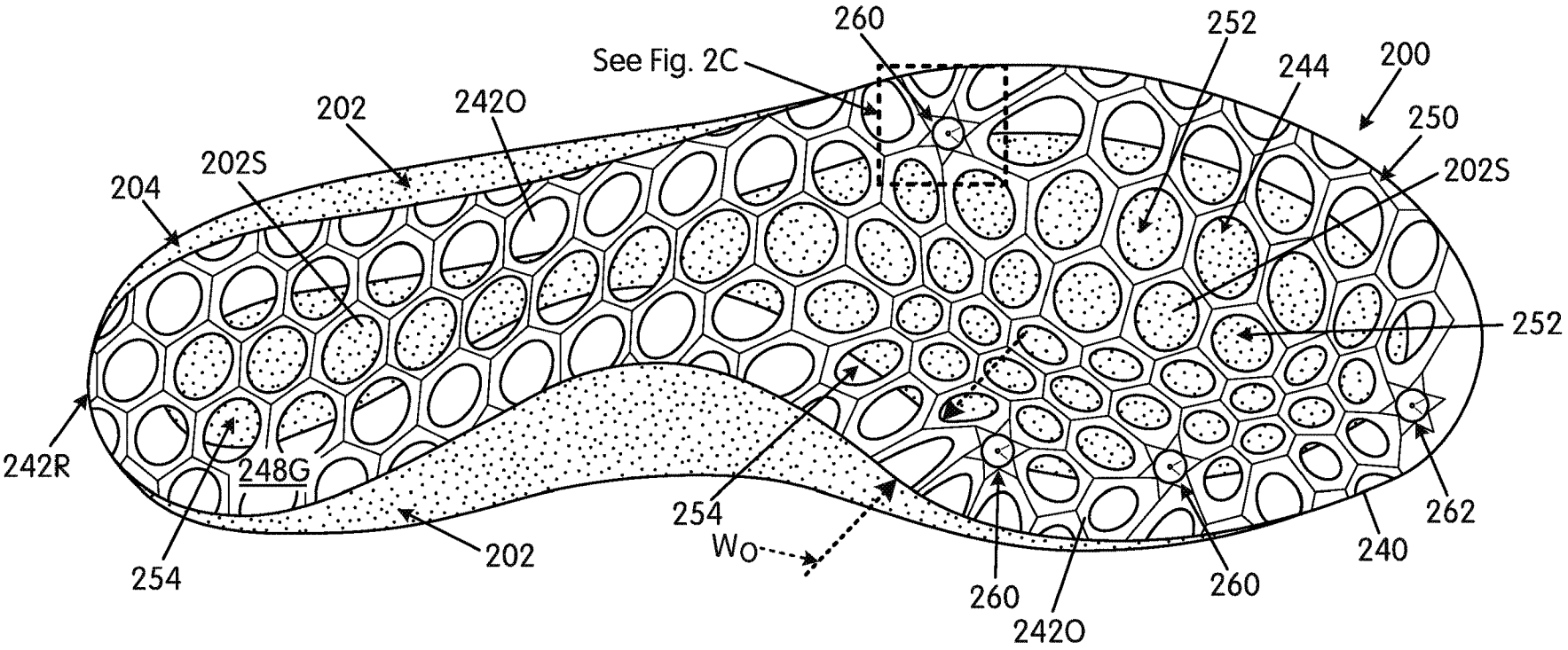
Figure 2D:
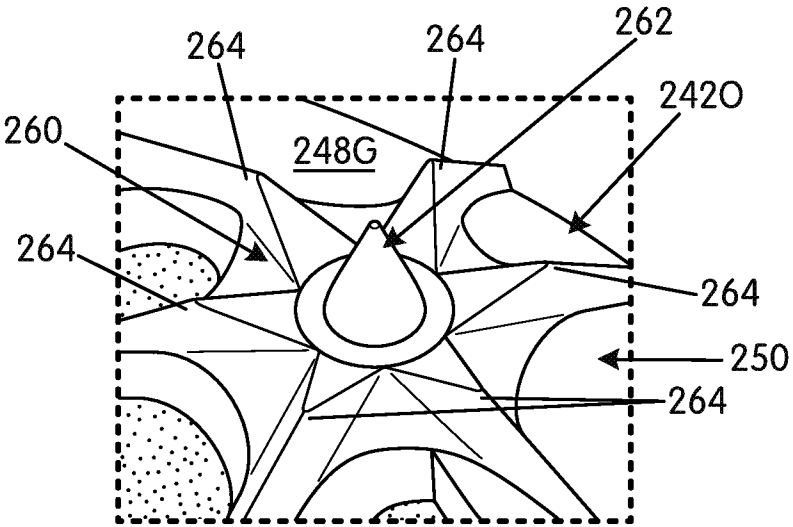
Figure 2C:
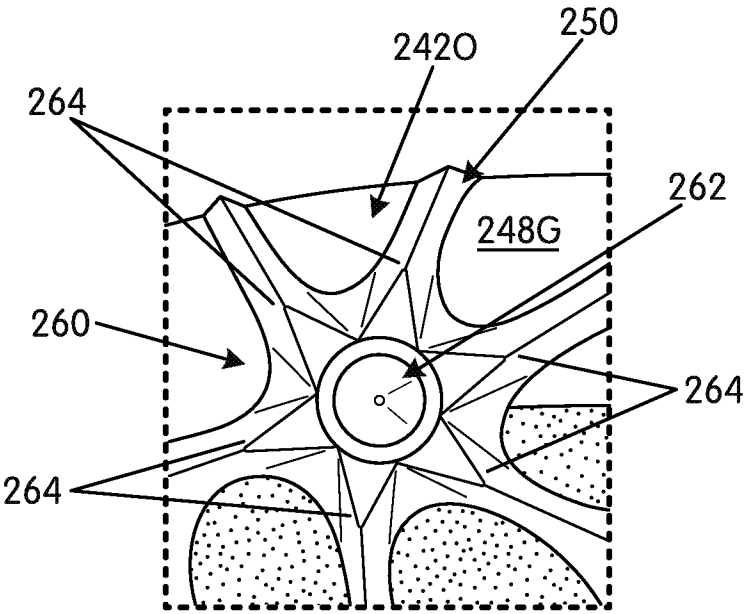

FIGS. 2A and 2B provide lateral side and bottom views, respectively, of an article of footwear 200 in accordance with at least some aspects of this invention. This example article of footwear 200 is a track shoe, and more specifically, a track shoe targeted for short or middle distance runs, such as 200 m, 400 m, 800 m, 1500 m, etc. (e.g., races typically run on a curved and/or banked track). Aspects of this invention, however, also may be used in shoes for other distance runs and/or other types of uses or athletic activities. The article of footwear 200 includes an upper 202 and a sole structure 204 engaged with the upper 202. The upper 202 and sole structure 204 may be engaged together in any desired manner, including in manners conventionally known and used in the footwear arts (such as by adhesives or cements, by stitching or sewing, by mechanical connectors, etc.).

The upper 202 of this example includes a foot-receiving opening 206 that provides access to an interior chamber into which the wearer's foot is inserted. The upper 202 further may include a tongue member located across the foot instep area and positioned so as to moderate the feel of the closure system 210 (which in this illustrated example constitutes a lace type closure system).

As mentioned above, the upper 202 may be made from any desired materials and/or in any desired constructions and/or manners without departing from this invention. As some more specific examples, at least a portion of the upper 202 (and optionally a majority, all, or substantially all of the upper 202) may be formed as a woven textile component and/or a knitted textile component. The textile components for upper 202 may have structures and/or constructions like those provided in FLYKNIT® brand footwear and/or via FLYWEAVE™ technology available in products from NIKE, Inc. of Beaverton, Oreg.

Additionally or alternatively, if desired, the upper 202 construction may include uppers having foot securing and engaging structures (e.g., "dynamic" and/or "adaptive fit" structures), e.g., of the types described in U.S. Patent Appln. Pubin. No. 2013/0104423, which publication is entirely incorporated herein by reference. As some additional examples, if desired, uppers and articles of footwear in accordance with this invention may include foot securing and engaging structures of the types used in FLYWIRE® Brand footwear available from NIKE, Inc. of Beaverton, Oreg. Additionally or alternatively, if desired, uppers and articles of footwear in accordance with this invention may include fused layers of upper materials, e.g., uppers of the types included in NIKE's "FUSE" line of footwear products. As still additional examples, uppers of the types described in U.S. Pat. Nos. 7,347,011 and/or 8,429,835 may be used without departing from this invention (each of U.S. Pat. Nos. 7,347,011 and 8,429,835 is entirely incorporated herein by reference).

The sole structure 204 of this example article of footwear 200 now will be described in more detail. As shown in FIGS.

2A and 2B, the sole structure 204 of this example includes one main component, namely a ground-engaging component 240, optionally engaged with the bottom surface 202S (e.g., a strobel member) and/or side surface of the upper 202 via adhesives or cements, mechanical fasteners, sewing or stitching, etc. The ground-engaging component 240 of this example has its rearmost extent 242R located at a rear heel support area.

Notably, in this illustrated example, no external midsole or internal midsole component (e.g., a foam material, a fluid-filled bladder, etc.) is provided. In this manner, the shoe/sole components will absorb little energy from the user when racing, and the vast majority of the force applied to the shoe by the user will be transferred to the contact surface (e.g., the track or ground). If desired, an interior insole component (or sock liner) or an interior midsole component may be provided to at least somewhat enhance the comfort of the shoe. Alternatively, if desired, a midsole component could be provided and located between (a) a bottom surface of the upper 202 (e.g., a strobel member) and (b) the ground-engaging component 240. Preferably, the midsole component, if any, will be thin, lightweight component, such as one or more of a foam material, a fluid-filled bladder, etc.

In this illustrated example, a bottom surface 202S of the upper 202 is exposed at an exterior of the sole structure 204 substantially throughout the bottom of the sole structure 204 (and exposed over more than 40%, more than 50%, and even more than 75% of the bottom surface area of the sole structure 204). As shown in FIG. 2B, the bottom surface 202S of the upper 202 is exposed at the forefoot support area, the arch support area, and/or the heel support area (through open cells 252 or any partially open cells 254 of the ground-engaging component 240 (also called the "open space" 244 herein) described in more detail below).

Example ground-engaging components 240 for sole structures 204/articles of footwear 200 in accordance with examples of this invention now will be described in more detail with reference to FIGS. 2A-3E. As shown, these example ground-engaging components 240 include an outer perimeter boundary rim 242O, for example, that may be at least 3 mm (0.12 inches) wide (and in some examples, is at least 4 mm (0.16 inches) wide, at least 6 mm (0.24 inches) wide, or even at least 8 mm (0.32 inches) wide). This "width" $W_O$ is defined as the direct, shortest distance from one (e.g., exterior) edge of the outer perimeter boundary rim 242O to its opposite (e.g., interior) edge by the open space 244, as shown in FIG. 2B. While FIG. 2B shows this outer perimeter boundary rim 242O extending completely and continuously around and defining 100% of an outer perimeter of the ground-engaging component 240, other options are possible. For example, if desired, there may be one or more breaks in the outer perimeter boundary rim 242O at the outer perimeter of the ground-engaging component 240 such that the outer perimeter boundary rim 242O is present around only at least 60%, at least 75%, at least 80%, at least 90%, or even at least 95% of the outer perimeter of the ground-engaging component 240. The outer perimeter boundary rim 242O may have a constant or changing width $W_O$ over the course of its perimeter. The outer perimeter boundary rim 242O also may extend to define the outer edge of the sole structure 204.

FIG. 2B further shows that the outer perimeter boundary rim 242O of the ground-engaging component 240 defines an open space 244 at least at a forefoot support area of the ground-engaging component 240, and in this illustrated example, the open space 244 extends into the arch support area and the heel support area of the ground-engaging component 240. The rearmost extent 242R of the outer perimeter boundary rim 242O of this example is located within the heel support area, and optionally at a rear heel support area of the ground-engaging component 240. The ground-engaging component 240 may fit and be fixed to a bottom surface 202S and/or side surface of the upper 202, e.g., by cements or adhesives, etc.

The ground-engaging components 240 of this example are shaped so as to extend completely across the forefoot support area of the sole structure 204 from the lateral side to the medial side. In this manner, the outer perimeter boundary rim 242O forms the medial and lateral side edges of the bottom of the sole structure 204 at least at the forefoot medial and forefoot lateral sides and around the front toe area. The ground-engaging component 240 also may extend completely across the sole structure 204 from the lateral side edge to the medial side edge at other areas of the sole structure 204, including throughout the longitudinal length of the sole structure 204. In this manner, the outer perimeter boundary rim 242O may form the medial and lateral side edges of the bottom of the sole structure 204 throughout the sole structure 204, if desired.

The outer perimeter boundary rim 242O of this illustrated example ground-engaging component 240 defines an upper-facing surface 248U (e.g., see FIGS. 2A, 3E, and 5F) and a ground-facing surface 248G (e.g., as shown in FIGS. 2A-2C and 3D) opposite the upper-facing surface 248U. The upper-facing surface 248U provides a surface (e.g., a smooth and/or contoured surface) for supporting the wearer's foot and/or engaging the upper 202 (and/or optionally engaging any present midsole component). The outer perimeter boundary rim 242O may provide a relatively large surface area for securely supporting a plantar surface of a wearer's foot. Further, the outer perimeter boundary rim 242O may provide a relatively large surface area for securely engaging another footwear component (such as the bottom surface 202S of the upper 202), e.g., a surface for bonding via adhesives or cements, for supporting stitches or sewn seams, for supporting mechanical fasteners, etc.

FIGS. 2B, 2C, 3D, and 3E further illustrate that the ground-engaging component 240 of this example sole structure 204 includes a support structure 250 that extends from the outer perimeter boundary rim 242O into and at least partially across (and optionally completely across) the open space 244. The top surface of this example support structure 250 at locations within the open space 244 lies flush with and/or smoothly transitions or morphs into the outer perimeter boundary rim 242O to provide a portion of the upper-facing surface 248U (and may be used for the purposes of the upper-facing surface 248U as described above).

The support structure 250 of these examples extends from the ground-facing surface 248G of the outer perimeter boundary rim 242O to define at least a portion of the ground-facing surface 248G of the ground-engaging component 240. In the illustrated examples of FIGS. 2A-2C and 3D-3E, the support structure 250 includes a matrix structure (also labeled 250 herein) extending from the ground-facing surface 248G of the outer perimeter boundary rim 242O and into, partially across, or fully across the open space 244 to define a cellular construction. The illustrated matrix structure 250 defines at least one of: (a) one or more open cells located within the open space 244, (b) one or more partially open cells located within the open space 244, and/or (c) one or more closed cells, e.g., located beneath the outer perimeter boundary rim 242O and/or primary cleat support area. An "open cell" constitutes a cell in which the perimeter of the cell opening is defined completely by the matrix structure 250 (note, for example, cells 252 in FIG. 2B). A "partially open cell" constitutes a cell in which one or more portions of the perimeter of the cell opening are defined by the matrix structure 250 within the open space 244 and one or more other portions of the perimeter of the cell opening are defined by another structure, such as the outer perimeter boundary rim 242O (note, for example, cells 254 in FIG. 2B) and/or a forefoot edge support (described in more detail below). A "closed cell" may have the outer matrix structure 250 (e.g., at the ground-facing surface 248G) but no opening (e.g., the cell may be formed such that the portion of the matrix 250 that would define the cell opening is located under the outer perimeter boundary rim 242O and/or is covered by the forefoot edge support). As shown in FIG. 2B, in this illustrated example matrix structure 250, the openings of at least 50% of the open cells 252 and/or partially open cells 254 of the open cellular construction (and optionally, at least 60%, at least 70%, at least 80%, at least 90%, or even at least 95%) have openings with curved perimeters and no distinct corners (e.g., round, elliptical, and/or oval shaped, e.g., as viewed at least from the upper-facing surface 248U). The open space 244 and/or matrix structure 250 may extend to all areas of the ground-engaging component 240 within the outer perimeter boundary rim 242O.

As further shown in FIGS. 2B-2D and 3D, the matrix structure 250 further defines one or more primary traction element or cleat support areas 260. Four separate cleat support areas 260 are shown in the examples of FIGS. 2A-2D, with: (a) three primary cleat support areas 260 on the medial side of the ground-engaging component 240 (one at or near a medial forefoot support area or a medial midfoot support area of the ground-engaging component 240, one forward of that one in the medial forefoot support area, and one forward of that one at the medial toe support area) and (b) one primary cleat support area 260 on the lateral side of the ground-engaging component 240 (at or near a lateral forefoot support area or a lateral midfoot support area of the ground-engaging component 240). Primary traction elements, such as track spikes 262 or other cleats, may be engaged or integrally formed with the ground-engaging component 240 at the cleat support areas 260 (e.g., with one cleat or track spike 262 provided per cleat support area 260). The cleats or track spikes 262 (also called "primary traction elements" herein) may be permanently fixed at cleat mount areas in their associated cleat support areas 260, such as by in-molding the cleats or track spikes 262 into the cleat support areas 260 when the matrix structure 250 is formed (e.g., by molding). In such structures, the cleat or track spike 262 may include a disk or outer perimeter member that is embedded in the material of the cleat support area 260 during the molding process. As another alternative, the cleats or track spikes 262 may be removably mounted to the ground-engaging component 240 at cleat mount areas, e.g., by a threaded type connector, a turnbuckle type connector, or other removable cleat/spike structures as are known and used in the footwear arts. Hardware or other structures for mounting the removable cleats may be integrally formed in the cleat support area 260 or otherwise engaged in the cleat support area 260 (e.g., by in-molding, adhesives, or mechanical connectors).

The cleat support areas 260 can take on various structures without departing from this invention. In the illustrated example, the cleat support areas 260 are defined by and as part of the matrix structure 250 as a thicker portion of matrix material located within or partially within the outer perimeter boundary rim 242O and/or located within the open space 244. As various options, if desired, one or more of the cleat support areas 260 may be defined in one or more of the following areas: (a) solely in the outer perimeter boundary rim 242O, (b) partially in the outer perimeter boundary rim 242O and partially in the open space 244, and/or (c) completely within the open space 244 (and optionally located at or adjacent the outer perimeter boundary rim 242O). When multiple cleat support areas 260 are present in a single ground-engaging component 240, all of the cleat support areas 260 need not have the same size, construction, and/or orientation with respect to the outer perimeter boundary rim 242O and/or open space 244 (although they all may have the same size, construction, and/or orientation, if desired).

While other constructions are possible, in this illustrated example (e.g., see FIGS. 2B-2D), the cleat support areas 260 are formed as generally hexagonal shaped areas of thicker material into which or at which at least a portion of the cleat/spike 262 and/or mounting hardware will be fixed or otherwise engaged. The cleat support areas 260 are integrally formed as part of the matrix structure 250 in this illustrated example. The illustrated example further shows that the matrix structure 250 defines a plurality of secondary traction elements 264 dispersed around the cleat support areas 260. While other options and numbers of secondary traction elements 264 are possible, in this illustrated example, a secondary traction element 264 is provided at each of the six corners of the generally hexagonal structure making up the cleat support area 260 (such that each cleat support area 260 has six secondary traction elements 264 dispersed immediately around it). The secondary traction elements 264 of this example are raised, sharp points or pyramid type structures made of the matrix 250 material and raised above a base surface 266 of the generally hexagonal cleat support area 260 (and may have a structure like those described below in conjunction with FIGS. 5A-5H). The free ends of the primary traction elements 262 extend beyond the free ends of the secondary traction elements 264 (in the cleat extension direction and/or when the shoe 200 is positioned on a flat surface) and are designed to engage the ground first. Note FIGS. 2A and 2D. If the primary traction elements 262 sink a sufficient depth into the contact surface (e.g., a track, the ground, etc.), the secondary traction elements 264 then may engage the contact surface and provide additional traction to the wearer. In an individual cleat mount area 260 around a single primary traction element 262, the points or peaks of the immediately surrounding secondary traction elements 264 that surround that primary traction element 262 may be located within 1.5 inches (3.8 cm) (and in some examples, within 1 inch (2.54 cm) or even within 0.75 inch (1.9 cm)) of the peak or point of the surrounded primary traction element 262 in that mount area 260.

In at least some examples of this invention, the outer perimeter boundary rim 242O and the support/matrix structure 250 extending into/across the open space 244 may constitute an unitary, one-piece construction. The one-piece construction can be formed from a polymeric material, such as a PEBAX® brand polymer material or a thermoplastic polyurethane material. As another example, if desired, the ground-engaging component 240 may be made as multiple parts (e.g., split at the forward-most toe area, split along the front-to-back direction, and/or split or separated at other areas), wherein each part includes one or more of: at least a portion of the outer perimeter boundary rim 242O and at least a portion of the support/matrix structure 250. As another option, if desired, rather than an unitary, one-piece construction, one or more of the outer perimeter boundary rim 242O and the support/matrix structure 250 individually may be made of two or more parts. The material of the matrix structure 250 and/or ground-engaging component 240 in general may be relatively stiff, hard, and/or resilient so that when the ground-engaging component 240 flexes in use (e.g., when sprinting or running fast), the material tends to return (e.g., spring) the component 240 back to or toward its original shape and structure when the force is removed or sufficiently relaxed (and optionally return energy to the wearer's foot), e.g., as occurs during a step cycle when the foot is lifting off the ground.

Optionally, the outer perimeter boundary rim 242O and the support structure 250, whether made from one part or more, will have a combined mass of less than 95 grams (exclusive of any separate primary traction elements, like spikes 262, and/or primary traction element mounting hardware), and in some examples, a combined mass of less than 75 grams, less than 65 grams, less than 55 grams, or even less than 50 grams. The entire ground-engaging component 240 also may have any of these weighting characteristics.

Figure 3A:
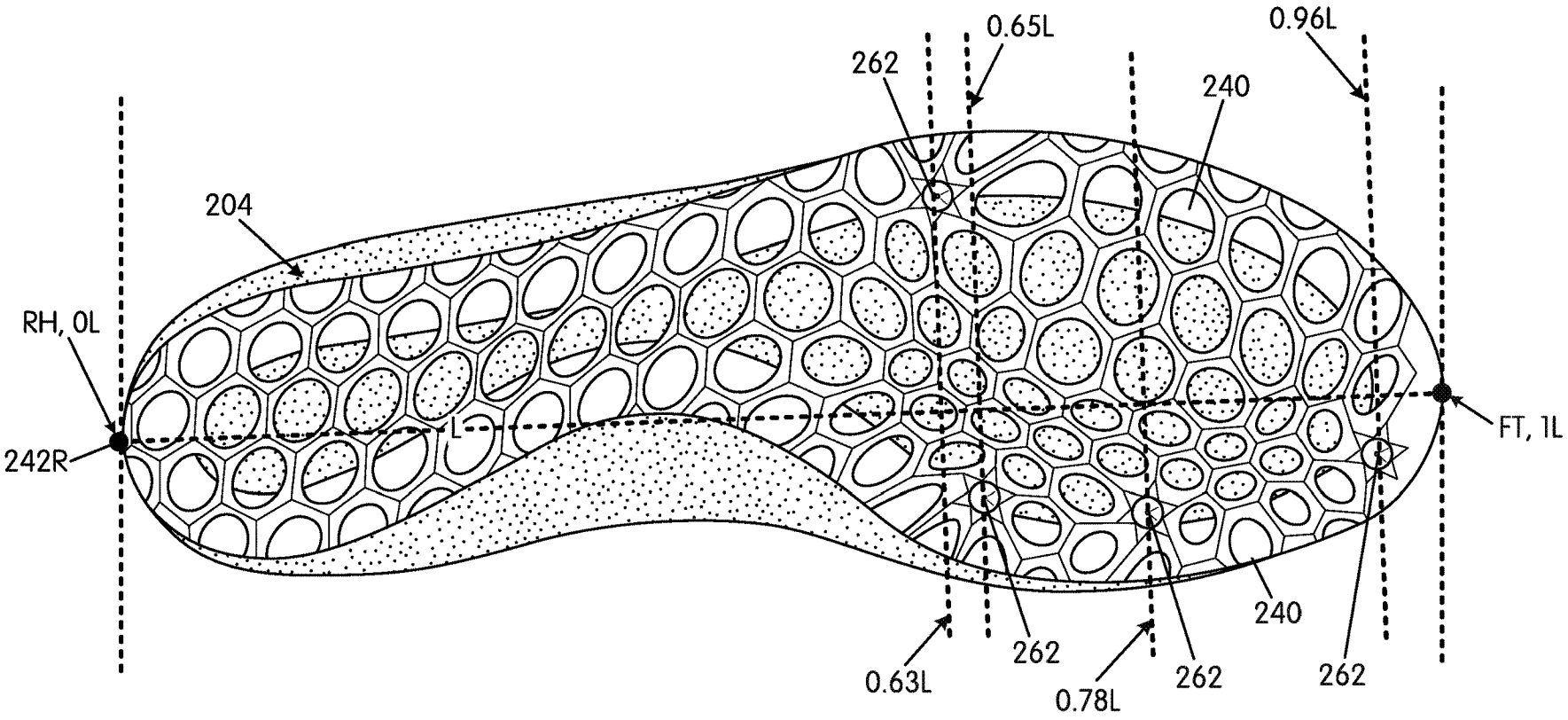
FIGS. 3A-3E and 4 are various views of example sole structures and ground-engaging components in accordance with this invention that illustrate additional example features and aspects of the invention.

FIGS. 3A through 5H are provided to illustrate additional features that may be present in ground-engaging components 240 and/or articles of footwear 200 in accordance with at least some aspects of this invention. FIG. 3A is a view similar to that of FIG. 2B with the rear heel RH and forward toe FT locations of the sole structure 204 identified and the longitudinal length L and direction identified. Planes perpendicular to the longitudinal direction (and going into and out of the page) are shown, and the locations of various footwear 200 and/or ground-engaging component 240 features are described with respect to the locations of these planes. For example, FIG. 3A illustrates that the rear-most extent 242R of the ground-engaging component 240 is located at 0L. In some examples of this invention, however, this rear-most extent 242R of the ground-engaging component 240 may be located within a range of 0L and 0.12L with respect to the shoe's and/or sole structure's overall longitudinal length L, and in some examples, within a range of 0L to 0.1L or even 0L to 0.075L based on the overall shoe's and/or overall sole structure's longitudinal length L.

Potential primary traction element attachment locations for the four illustrated primary traction elements 262 are described in the following table (with the "locations" being measured from a center location (or point) of the ground-contacting portion of the cleat/spike 262 and being measured with respect to the longitudinal length(s) of the sole structure 204 and/or the footwear structure 200):

| | General Range | More Specific Range | Illustrated Location |
|---|---|---|---|
| Rear Medial Cleat | 0.5 L to 0.75 L | 0.55 L to 0.7 L | 0.65 L |
| Middle Medial Cleat | 0.65 L to 0.88 L | 0.7 L to 0.82 L | 0.78 L |
| Forward Medial Cleat | 0.84 L to 0.99 L | 0.88 L to 0.98 L | 0.96 L |
| Lateral Cleat | 0.5 L to 0.8 L | 0.56 L to 0.72 L | 0.63 L |

Notably, in this illustrated example, the only lateral side primary cleat element 262 (or at least the only lateral side forefoot primary cleat element 262) is located further rearward than all of the medial side primary cleat elements (or at least rearward of all medial side forefoot primary cleat elements 262). If desired, however, one or more additional primary traction elements 262 can be provided at other locations of the ground-engaging component 240 structure, including rearward of either or both of the identified rear cleats, between the identified medial cleats, forward of either or both of the forward-most cleats, and/or between the lateral and medial cleats (e.g., in the matrix structure 250 within the open area 244, at a central forward toe location, etc.).

FIG. 3A further illustrates that the forward-most extent of the outer perimeter boundary rim 242O is located at 1.0L (at the forward-most toe location FT). This forward-most extent of the outer perimeter boundary rim 242O, however, may be located at other places, if desired, such as within a range of 0.90L and 1.0L, and in some examples, within a range of 0.92L to 1.0L or even 0.95L to 1.0L, based on the shoe structure's overall longitudinal length.

Figure 3B:
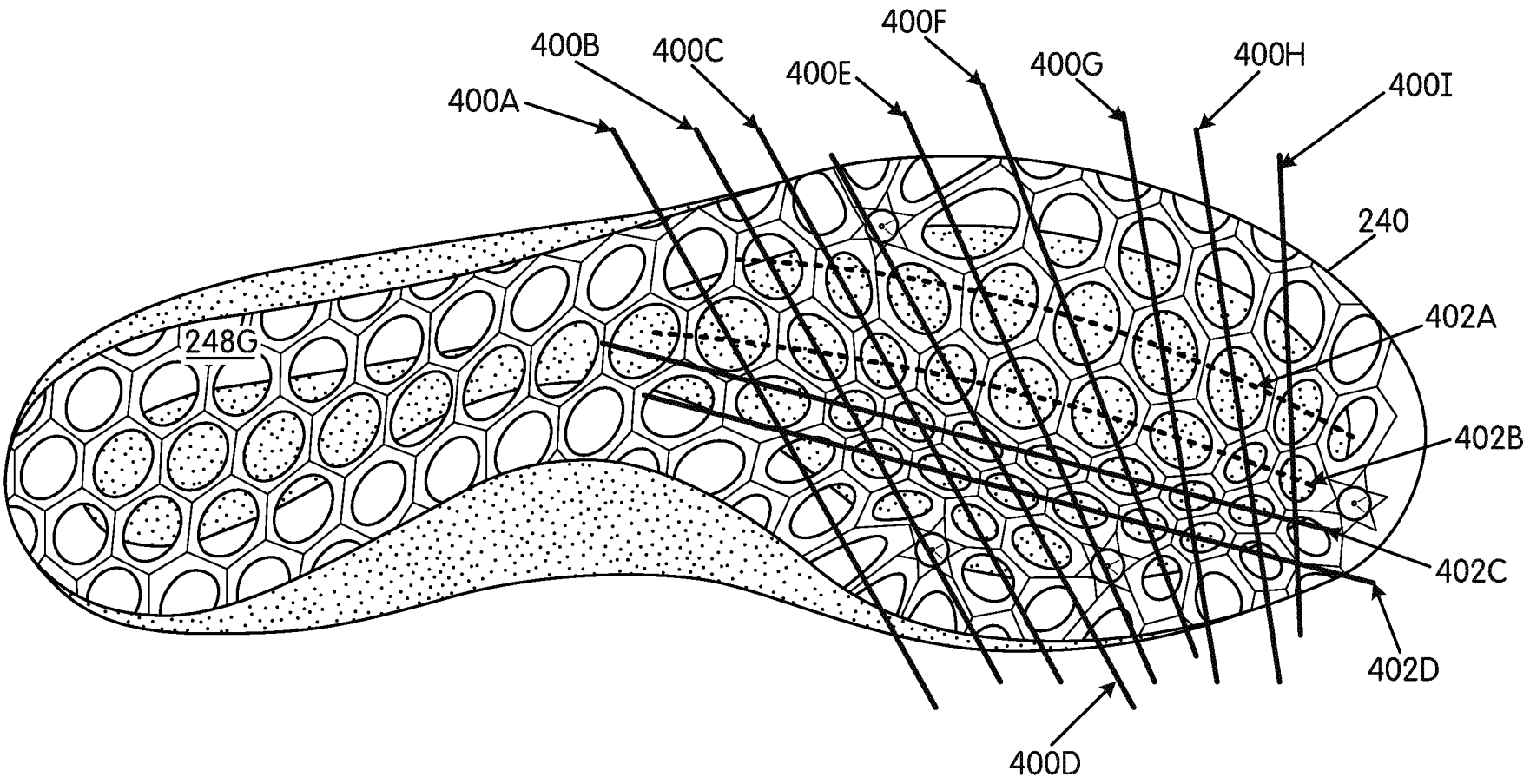

FIG. 3B further illustrates that in this example ground-engaging component structure 240, some cells of the matrix structure 250 are generally formed in lines or along curves that extend across the ground-engaging component 240 and the sole structure 204. The term "cells" used in this context is used generically to refer to any one or more of open cells 252, partially open cells 254, and/or closed cells (e.g., cells completely formed by the matrix structure 250 and closed off within the outer perimeter boundary rim 242O) in any numbers or combinations. In some example structures 240 in accordance with this aspect of the invention, from 3 to 16 "lines" or "curves" of adjacent cells may be formed in the ground-engaging element structure 240 (and in some examples, from 4-12 lines or curves of adjacent cells or even from 6-10 lines or curves of this type). Each "line" or "curve" of adjacent cells extending in the generally medial-to-lateral side direction may contain from 2 to 12 cells, and in some examples, from 3 to 10 cells or from 3-8 cells.

More specifically, and referring to FIG. 3B (which is a view similar to FIG. 2B), the ground-facing surface 248G of the ground-engaging component 240 is shown with additional lines to highlight certain cell features that may be present in at least some example structures according to the invention. For example, this illustrated matrix structure 250 defines several sets of at least partially open cells (meaning open cells 252 and/or partially open cells 254), wherein geographical centers of at least three cells of these sets of at least partially open cells are substantially aligned or highly substantially aligned. Examples of these "sets" of "aligned" cells are shown in FIG. 3B at alignment lines 400A-400I. Notably, while not a requirement for any or all "sets" of three or more aligned cells, at least the "alignment lines" 400A-400F shown in this illustrated example extend from a rear lateral direction toward a forward medial direction of the ground-engaging component 240 and/or the sole structure 204 (and not necessarily in the direct transverse direction). If desired, any one or more sets of cells may be substantially aligned along a line that extends from the rear lateral direction toward the forward medial direction of the ground-engaging component 240 and/or sole structure 204. These sets of "substantially aligned" or "highly substantially aligned" cells can help provide more natural flexion and motion for the foot, e.g., as the person's weight rolls forward in a direction from the heel to the toe and/or from the midfoot to the toe during a step cycle. For example, the substantially aligned or highly substantially aligned open spaces 244 along lines 400A-400F (as well as lines 400G-400I) provide and help define lines of flex that extend at least partially across the sole structure 204 and/or the ground-engaging component 240 from the lateral side to the medial side direction and help the ground-engaging component 240 bend with the foot as the wearer rolls the foot forward for the toe-off phase of a step cycle.

FIG. 3B further shows sets of adjacent cells located along one or more lines or curves 402A-402D that extend in the generally forward-to-rear direction of the ground-engaging component 240 and/or sole structure 204. One or more of the lines or curves 402A-402D may be oriented so that their concave surface (if any) faces the medial side of the ground-engaging component 240 and/or sole structure 204 and so that their convex surface (if any) faces the lateral side of the ground-engaging component 240 and/or sole structure 204. The curve(s) (e.g., 402A, 402B) may be generally gently and smoothly curved (e.g., arcs of a circle) or relatively linear. While four generally front-to-back sets of adjacent at least partially open cells are shown as lines or curves 402A-402D in FIG. 3B, more or fewer sets could be provided, if desired. As a more specific example, from one to eight linear or curved sets of adjacent at least partially open cells 402A-402D could be provided across the ground-engaging component 240 and/or sole structure 204, and each of these sets of cells 402A-402D may include from 3-12 cells, and in some examples, from 3-10 cells, or from 4-10 cells in the forefoot area. These sets of adjacent at least partially open cells 402A-402D also can help provide more natural flexion and motion for the foot as the person's weight rolls forward from the heel and/or midfoot to the toe and from the lateral side to the medial side during a step cycle. For example, adjacent open spaces 244 along lines or curves 402A-402D provide and help define lines or curves of flex that extend across the foot from the rear-to-front direction and help the ground-engaging component 240 bend along a front-to-back line or curve with the foot as the wearer rolls the foot from the lateral side to the medial side for the toe-off phase of a step cycle.

As shown by FIGS. 2B and 3A-3E, in these illustrated example ground-engaging components 240, an average open cell 252 size defined by the matrix structure 250 on a medial forefoot side support area of the ground-engaging component 240 is smaller than an average open cell 252 size defined by the matrix structure 250 on a lateral forefoot side support area of the ground-engaging component 240. Compare, for example: (a) the areas of the open cells (e.g., cell opening area) along line/curve 402C and those toward the medial side with (b) the areas of the open cells (e.g., cell opening area) along curve 402B and those toward the lateral side. Also, as further shown in these figures, an average open cell 252 size defined by the matrix structure 250 in a first metatarsal head support area ("big toe" side) of the ground-engaging component 240 is smaller than an average open cell 252 size defined by the matrix structure 250 in a fourth and/or fifth metatarsal head support area ("little toe" side) of the ground-engaging component 240. The smaller open cells 252 at the first metatarsal head support area provide somewhat greater stiffness and support, e.g., to receive force/weight during the toe-off or push-off phase of a step cycle.

Also, in this same vein, if desired, the matrix structure 250 may define open cell 252 sizes such that an average open cell size (e.g., cell opening area) defined by the matrix structure 250 on a medial side of a longitudinal center line of the ground-engaging component 240 and/or sole structure 204, at least at the forefoot support area, is smaller than an average open cell size (e.g., cell opening area) defined by the matrix structure 250 on a lateral side of the longitudinal center line, again, at least at the forefoot support area. The "longitudinal center line" of a ground-engaging component 240 and/or a sole structure 204 can be found by locating the center points of line segments extending in the transverse direction (see FIG. 1) from the lateral side edge to the medial side edge of the ground-engaging component 240 and/or the sole structure 204 all along the longitudinal length of the component 240/sole structure 204.

Figure 3C:
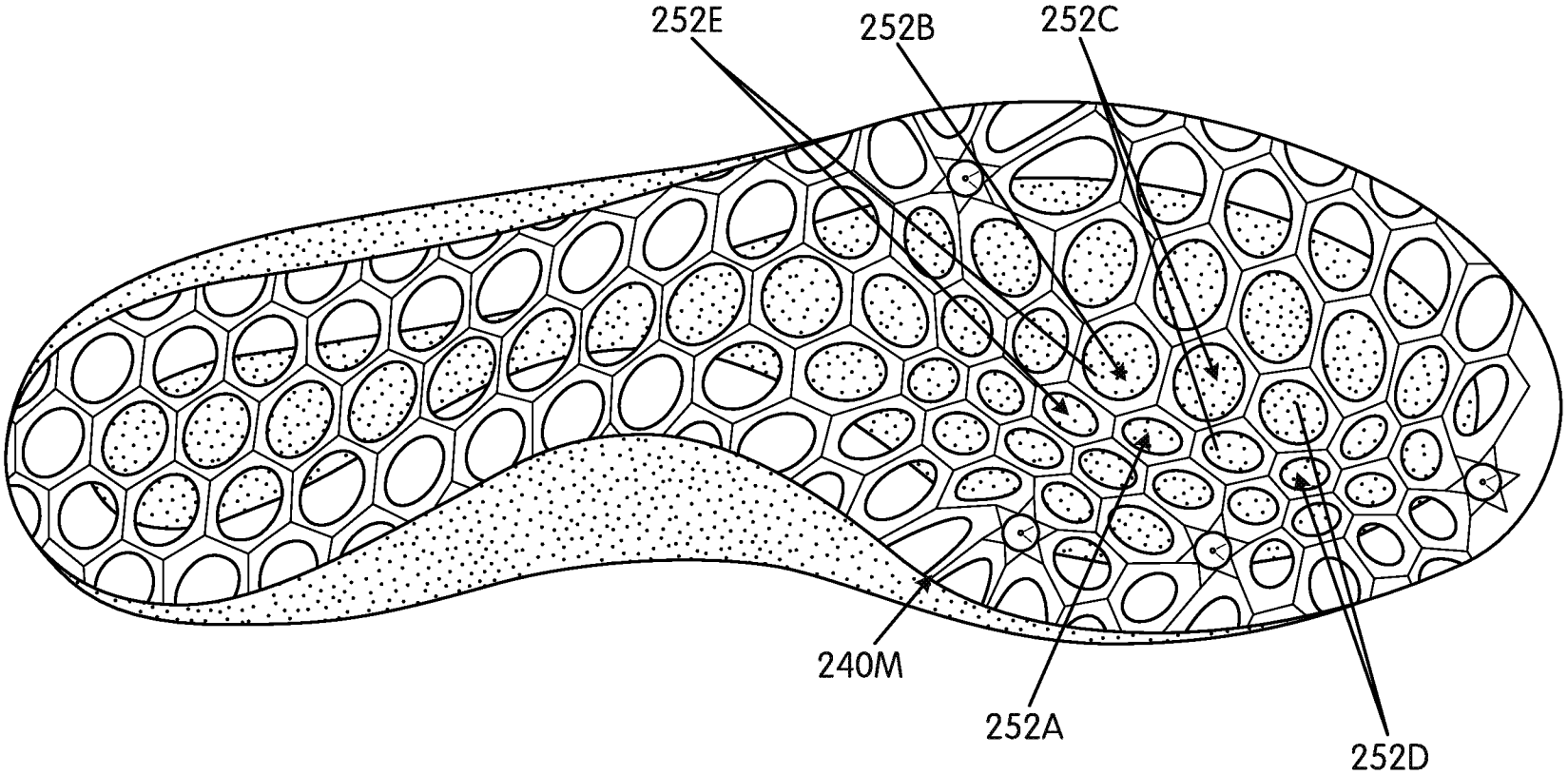
Figure 3D:
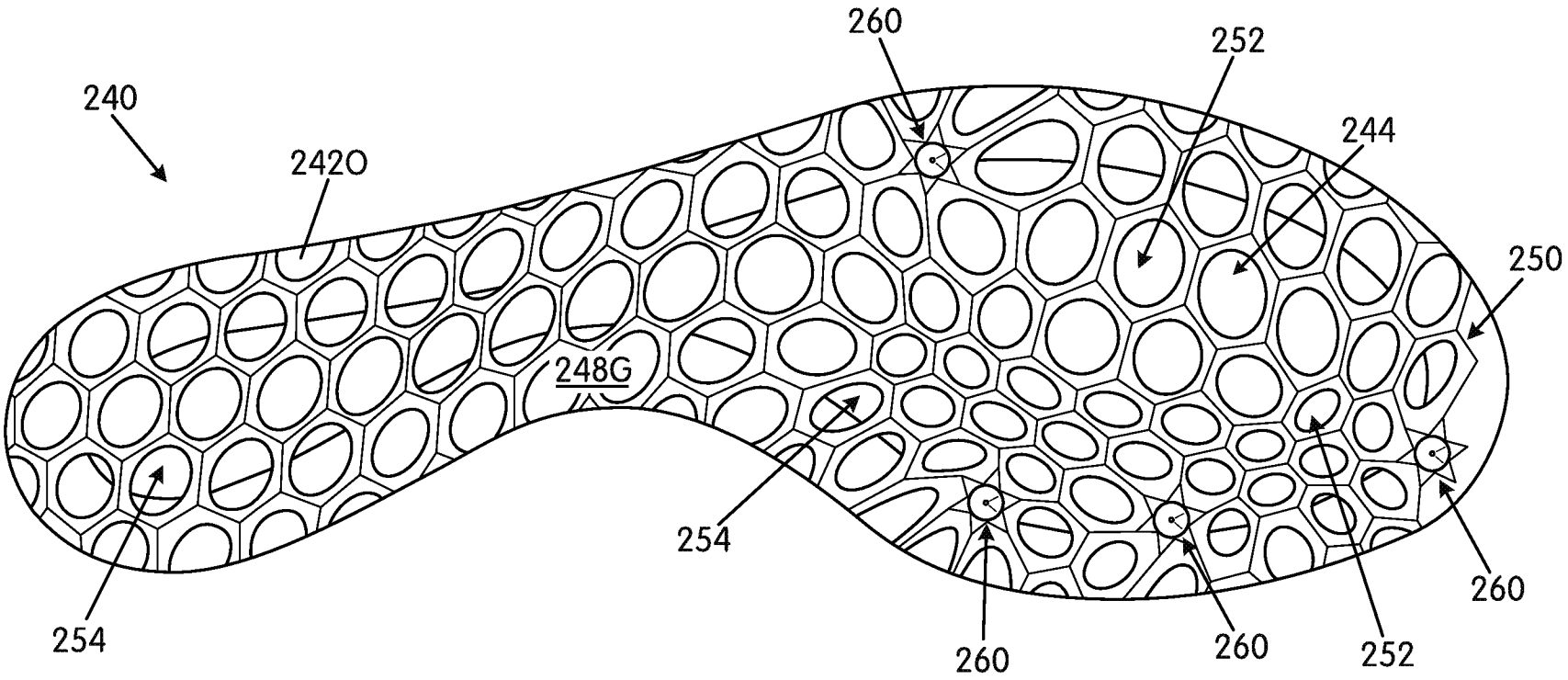
Figure 3E:
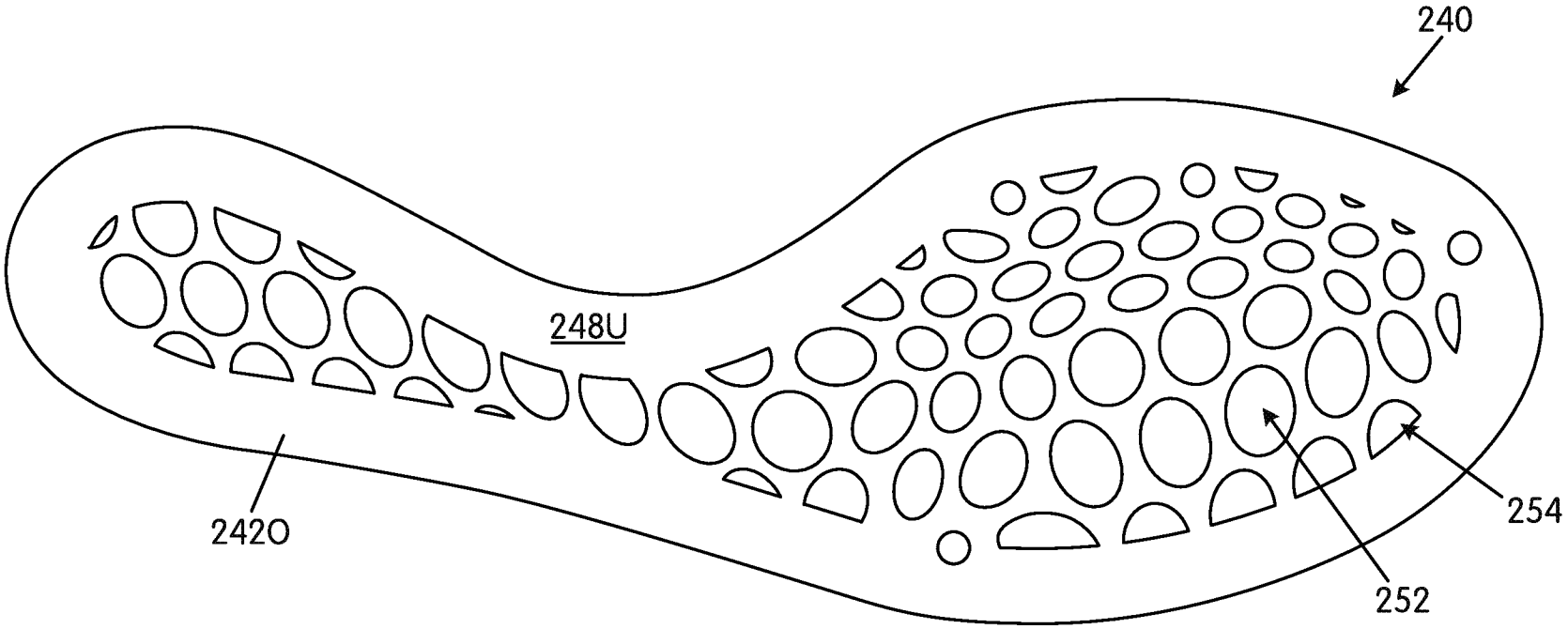
Figure 4:
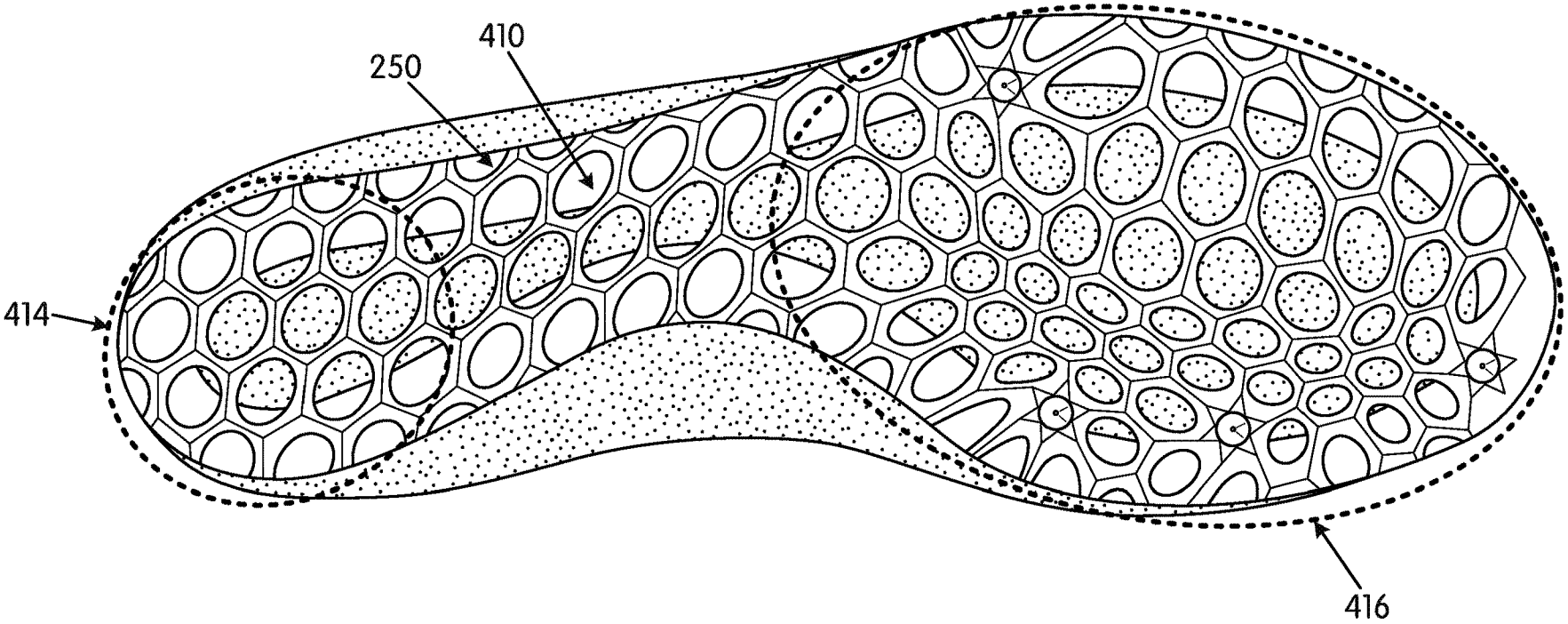

Additional potential features of various specific areas of the ground-engaging component 240 now will be described in more detail. As shown in FIG. 3C, in the forefoot support area, the matrix structure 250 of this example defines a first open cell (e.g., 252A) and an adjacent second open cell (252B) in which the first open cell 252A has a cross sectional area (area of the opening) of less than 50% (and in some adjacent cell pairs, less than 35% or even less than 25%) of a cross sectional area (area of the opening) of the second open cell 252B. Further, a geographic center of the first (smaller) open cell 252A is located closer to the medial side edge 240M than is a geographic center of the second (larger) open cell 252B. As shown in FIG. 3C, the first (smaller) open cell 252A is elongated in a front-to-rear direction. Also, while not shown in specifically identified cells in FIG. 3C, the second (larger) open cell 252B may be elongated in a medial side-to-lateral side direction, if desired. The matrix structure 250 of FIG. 3C includes additional adjacent cell pairs or sets (e.g., 252C, 252D, and 252E) having one or more of the same relative size and/or location characteristics of adjacent cell pair 252A/252B described above. Also, if desired, the adjacent cell pairs or sets (e.g., 252A/B, 252C, 252D, 252E) may lie adjacent one another (e.g., with the smaller cells of the pair or sets (closer to the medial side edge 240M) adjacent one another moving in the front-to-back direction and the larger cells of the pair or sets (further from the medial side edge 240M) adjacent one another moving in the front-to-back direction.

As further shown with respect to the open cells labeled 252A-252E in FIG. 3C, the larger and smaller open cells may be arranged adjacent one another in generally triangular arrangements and/or such that some open cells 252 (or other cells) will have six cells around and adjacent to them. More specifically, the cells 252A-252E (and others) are arranged such that two smaller, adjacent (and closer to the medial side edge 240M) open cells are located adjacent one larger open cell (which is located further from the medial side edge 240M than the two smaller adjacent open cells). Likewise, two larger, adjacent (and further from the medial side edge 240M) open cells are located adjacent one smaller open cell (which is located closer the medial side edge 240M than the two larger adjacent open cells). Thus, two of the smaller open cells and one larger open cell are located in a generally triangular arrangement and two larger open cells and one smaller open cell are located in a generally triangular arrangement. This generally triangular arrangement may be repeated one or more times in the forefoot matrix structure area.

Figure 5B:
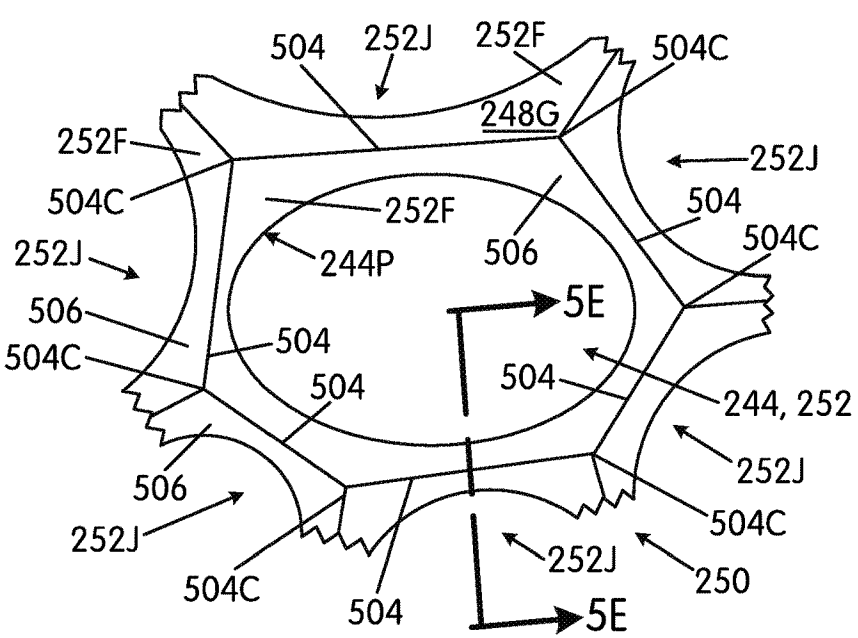
FIGS. 5A-5H provide various views to illustrate additional features of the ground-engaging component's support structure in accordance with some example features of this invention.
Figure 5A:
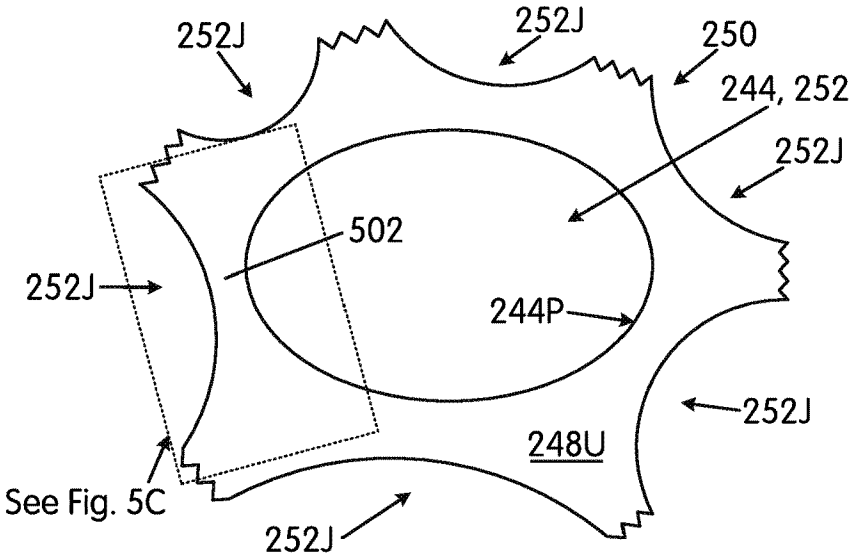
Figure 5E:
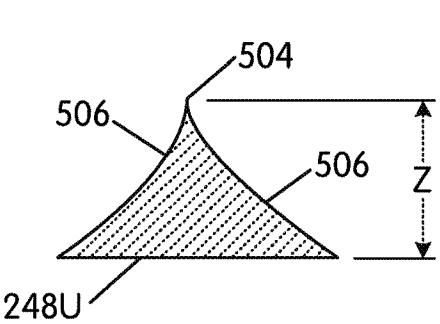
Figure 5D:
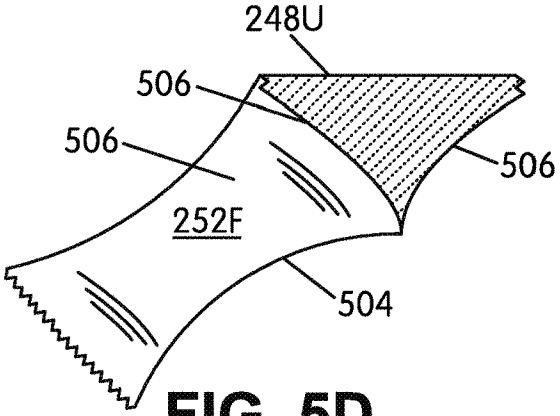
Figure 5C:
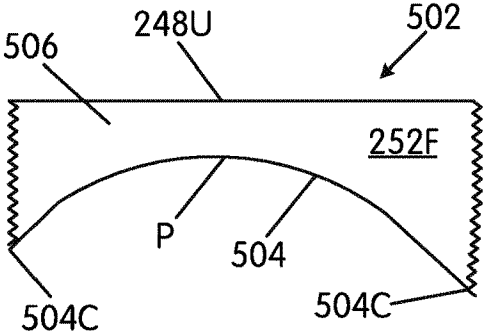

FIGS. 5A through 5H are provided to help illustrate potential features of the matrix structure 250 and the various cells described above. FIG. 5A provides an enlarged top view showing the upper-facing surface 248U at an area around an open cell 252 defined by the matrix structure 250 (the open space is shown at 244). FIG. 5B shows an enlarged bottom view of this same area of the matrix structure 250 (showing the ground-facing surface 248G). FIG. 5C shows a side view at one leg 502 of the matrix structure 250, and FIG. 5D shows a cross-sectional and partial perspective view of this same leg 502 area. As shown in these figures, the matrix structure 250 provides a smooth top (upper-facing) surface 248U but a more angular ground-facing surface 248G. More specifically, at the ground-facing surface 248G, the matrix structure 250 defines a generally hexagonal ridge 504 around the open cell 252, with the corners 504C of the hexagonal ridge 504 located at a junction area between three adjacent cells in a generally triangular arrangement (the junction of the open cell 252 and two adjacent cells 252J, which may be open, partially open, and/or closed cells, in this illustrated example).

As further shown in these figures, along with FIG. 5E (which shows a sectional view along line 5E-5E of FIG. 5B), the side walls 506 between the upper-facing surface 248U at cell perimeter 244P and the ground-facing surface 248G, which ends at ridge 504 in this example, are sloped and/or curved. Thus, the overall matrix structure 250, at least at some locations between the generally hexagonal ridge 504 corners 504C, may have a triangular or generally triangular shaped cross section (e.g., see FIGS. 5D and 5E). Moreover, as shown in FIGS. 5C and 5D, the generally hexagonal ridge 504 may be sloped or curved from one corner 504C to the adjacent corners 504C (e.g., with a local maxima point P located between adjacent corners 504C). The side walls 506 may have a planar surface (e.g., like shown in FIG. 5H), a partially planar surface (e.g., planar along some of its height/thickness dimension Z), a curved surface (e.g., a concave surface as shown in FIG. 5E), or a partially curved surface (e.g., curved along some of its height dimension Z).

The raised corners 504C of the generally hexagonal ridge 504 in this illustrated example ground-engaging component 240 may be formed as sharp peaks that may act as secondary traction elements at desired locations around the ground-engaging component 240. As evident from these figures and the discussion above, the generally hexagonal ridges 504 and side walls 506 from three adjacent cells (e.g., 252 and two 252J cells) meet at a single (optionally raised) corner 504C and thus may form a substantially pyramid type structure (e.g., a pyramid having three side walls 252F, 506 that meet at a point 504C). This substantially pyramid type structure can have a sharp point (e.g., depending on the slopes of walls 252F, 506), which can function as a secondary traction element when it contacts the ground in use. This same type of pyramid structure formed by matrix 250 also may be used to form the secondary traction elements 264 at cleat support areas 260 and/or around closed cells (e.g., beneath the outer perimeter boundary rim 242O).

Not every cell (open, partially open, or closed) in the ground-engaging component 240 needs to have this type of secondary traction element structure (e.g., with raised pointed pyramids at the generally hexagonal ridge 504 corners 504C), and in fact, not every generally hexagonal ridge 504 corner 504C around a single cell 252 needs to have a raised secondary traction element structure. One or more of the ridge components 504 of a given cell 252 may have a generally straight line structure along the ground-facing surface 248G and/or optionally a linear or curved structure that moves closer to the upper-facing surface 248U moving from one corner 504C to an adjacent corner 504C. In this manner, secondary traction elements may be placed at desired locations around the ground-engaging element 240 structure and left out (e.g., with smooth corners 504C and/or edges in the z-direction) at other desired locations. Additionally or alternatively, if desired, raised points and/or other secondary traction elements could be provided at other locations on the matrix structure 250, e.g., anywhere along ridge 504 or between adjacent cells. As some more specific examples, a portion of the arch support area (e.g., area 410 in FIG. 4) may have no or fewer prominent secondary traction elements (e.g., smoother matrix 250 walls), while other areas (e.g., the heel support area 414, the forefoot area 416 (e.g., including one or more of the forward toe area, the lateral forefoot side support area, the medial forefoot side support area, and/or the central forefoot support area, including areas beneath at least some of the metatarsal head support areas) may include the secondary traction elements (or more pronounced secondary traction elements).

Notably, in this example construction, the matrix structure 250 defines at least some of the cells 252 (and 252J) such that the perimeter of the entrance to the cell opening 252 around the upper-facing surface 248U (e.g., defined by perimeter 244P of the ovoid shaped opening) is smaller than the perimeter of the entrance to the cell opening 252 around the ground-facing surface 248G (e.g., defined by the generally hexagonal perimeter ridge 504). Stated another way, the area of the entrance to the cell opening 252 from the upper-facing surface 248U (e.g., the area within and defined by the perimeter 244P of the ovoid shaped opening) is smaller than the area of the entrance to the cell opening 252 from the ground-facing surface 248G (e.g., the area within and defined by the generally hexagonal perimeter ridge 504). The generally hexagonal perimeter ridge 504 completely surrounds the perimeter 244P in at least some cells. These differences in the entrance areas and sizes are due to the sloped/curved sides walls 506 from the upper-facing surface 248U to the ground-facing surface 248G as shown in FIGS. 5D, 5E, and 5H.

Figure 5G:
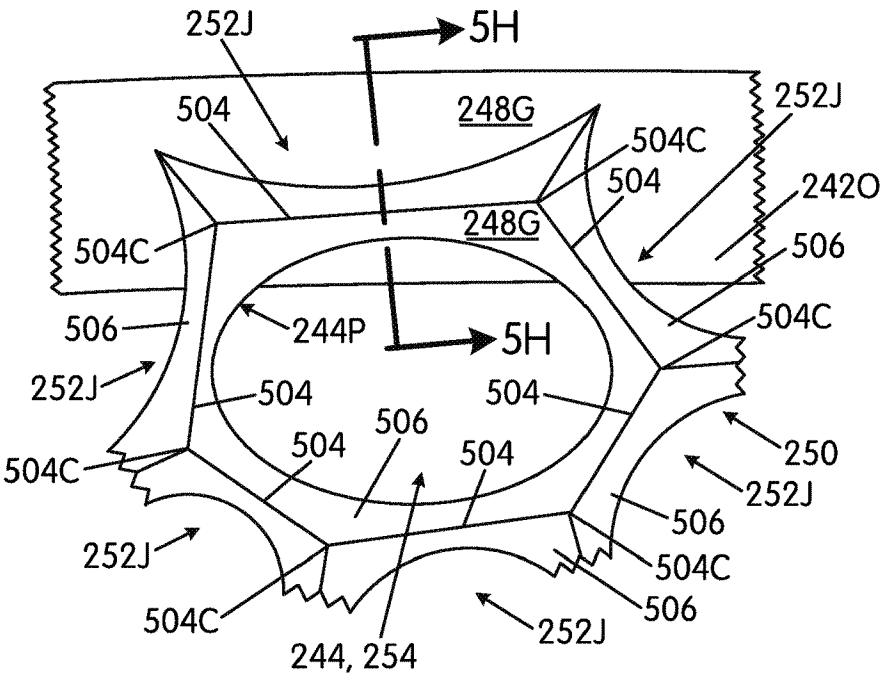
Figure 5F:
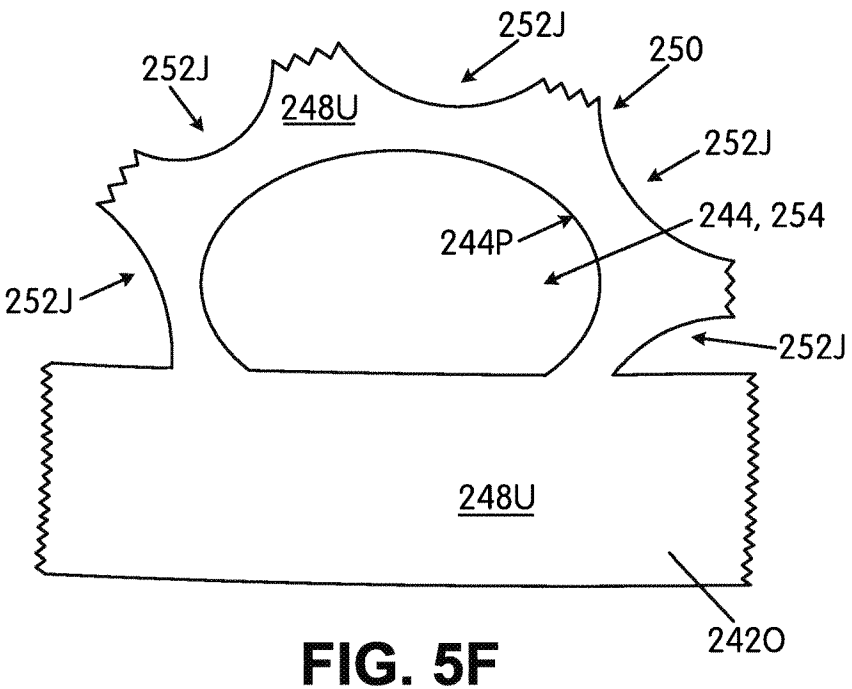
Figure 5H:
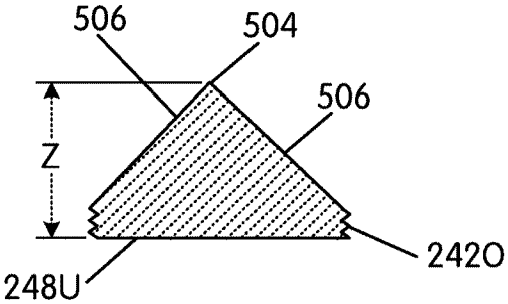

FIGS. 5F through 5H show views similar to those in FIGS. 5A, 5B, and 5E, respectively, but with a portion of the matrix structure 250 originating in the outer perimeter boundary rim 242O (and thus the cell is a partially open cell 254). As shown in FIG. 5G, in this illustrated example, the matrix structure 250 morphs outward and downward from the ground-facing surface 248G of the outer perimeter boundary rim 242O. This may be accomplished, for example, by molding the matrix structure 250 as an unitary, one-piece component with the outer perimeter boundary rim member 242O. Alternatively, the matrix structure 250 could be formed as a separate component that is fixed to the outer perimeter boundary rim member 242O, e.g., by cements or adhesives, by mechanical connectors, etc. As another option, the matrix structure 250 may be made as an unitary, one-piece component with the outer perimeter boundary rim member 242O by rapid manufacturing techniques, including rapid manufacturing additive fabrication techniques (e.g., 3D printing, laser sintering, etc.) or rapid manufacturing subtractive fabrication techniques (e.g., laser ablation, etc.). The structures and various parts shown in FIGS. 5F-5H may have any one or more of the various characteristics, options, and/or features of the similar structures and parts shown in FIGS. 5A-5E (and like reference numbers in these figures represent the same or similar parts to those used in other figures).

FIGS. 6A-6G provide various views of another example sole structure 604 for an article of footwear in accordance with some examples of this invention. This example sole structure 604 may be used in articles of footwear, such as track shoes targeted for short or middle distance runs, such as 200 m, 400 m, 800 m, 1500 m, etc., including shoes for use on a curved and/or banked track. The sole structure 604 may be used with any desired type of upper and/or overall shoe construction, including shoe constructions and/or uppers having any of the constructions and/or upper 202 features described above in conjunction with the shoe 200 of FIGS. 2A-5H.

The sole structure 604 of this example now will be described in more detail. As shown in FIGS. 6A-6G, the sole structure 604 of this example includes one main component, namely a ground-engaging component 640, that optionally may be engaged with a bottom surface (e.g., a strobel member) and/or side surface of an upper (e.g., like bottom surface 202S and upper 202) via adhesives or cements, mechanical fasteners, sewing or stitching, etc. The ground-engaging component 640 of this example has its rearmost extent 642R located at a rear heel support area and its forward most extent 642T at the forward toe support area.

Like the structures described above, if desired, utilizing this example ground-engaging component 640, no external midsole or internal midsole component (e.g., a foam material, a fluid-filled bladder, etc.) need be provided in the article of footwear. In this manner, the shoe/sole components will absorb little energy from the user when racing, and the vast majority of the force applied to the shoe by the user will be transferred to the contact surface (e.g., the track or ground) and returned to the user's foot. If desired, an interior insole component (or sock liner) and/or interior midsole component may be provided to at least somewhat enhance the comfort of the shoe. Alternatively, if desired, a midsole component could be provided and located between (a) a bottom surface of the upper (e.g., a strobel member) and (b) the ground-engaging component 640. Preferably, the midsole component, if any, will be thin, lightweight component, such as one or more of a foam material, a fluid-filled bladder, etc.

Also, in this illustrated example ground-engaging component 640, a bottom surface of the upper may be exposed at an exterior of the sole structure 604 substantially throughout the bottom of the sole structure 604 (and exposed over more than 40%, more than 50%, and even more than 75% of the bottom surface area of the sole structure 604). Like the example shown in FIG. 2B, the bottom surface of the upper may be exposed at the forefoot support area, the arch support area, and/or the heel support area (through open cells 652 or any partially open cells 654 of the ground-engaging component 640).

Figure 6A:
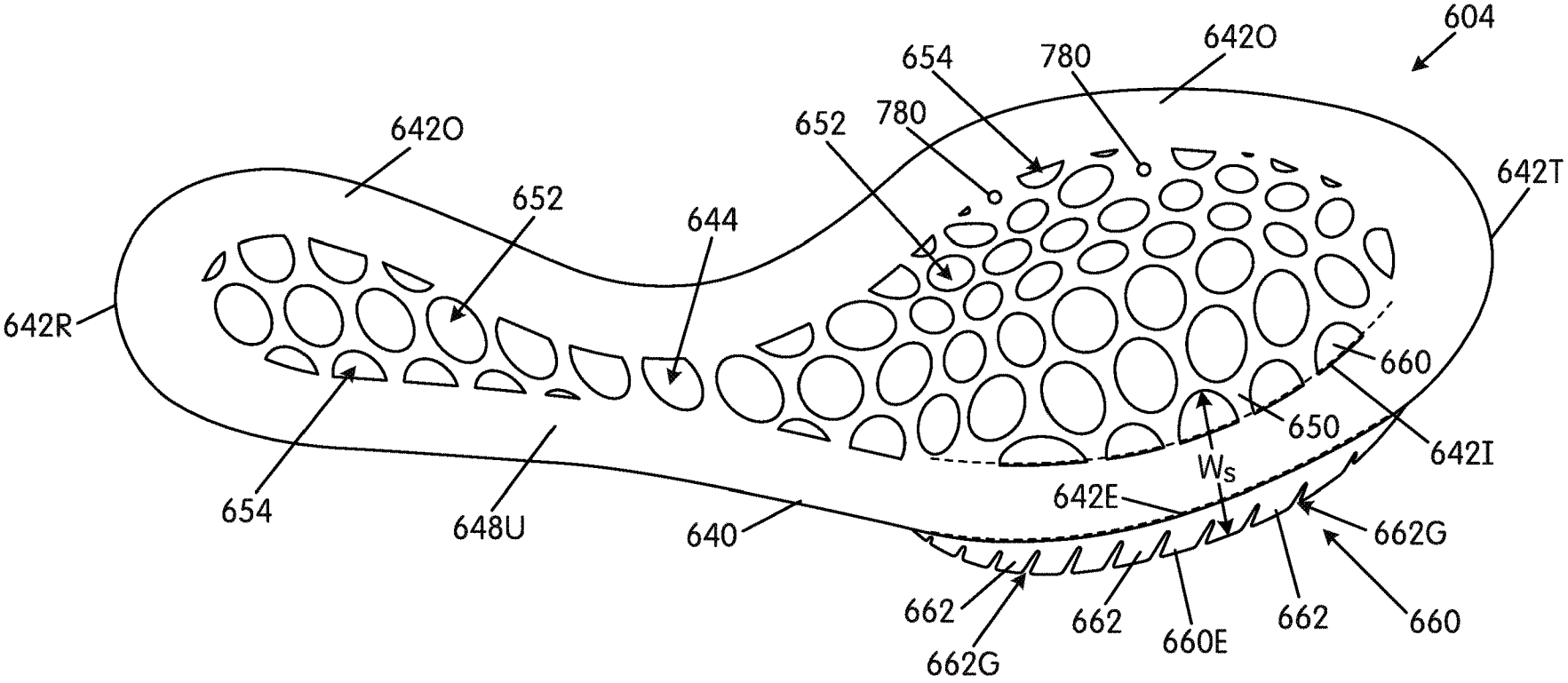
FIGS. 6A-6G provide views illustrating another example ground-engaging component in accordance with this invention.
Figure 6B:
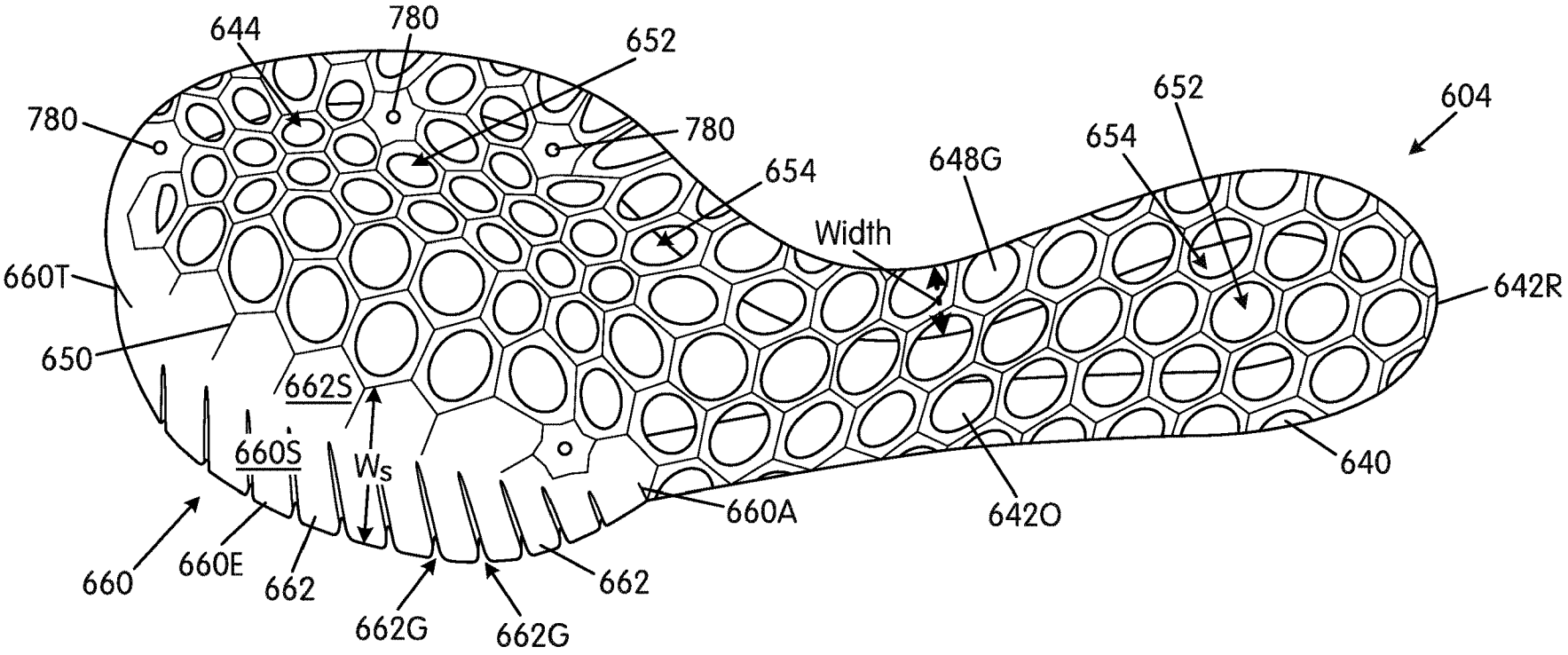
Figure 6C:
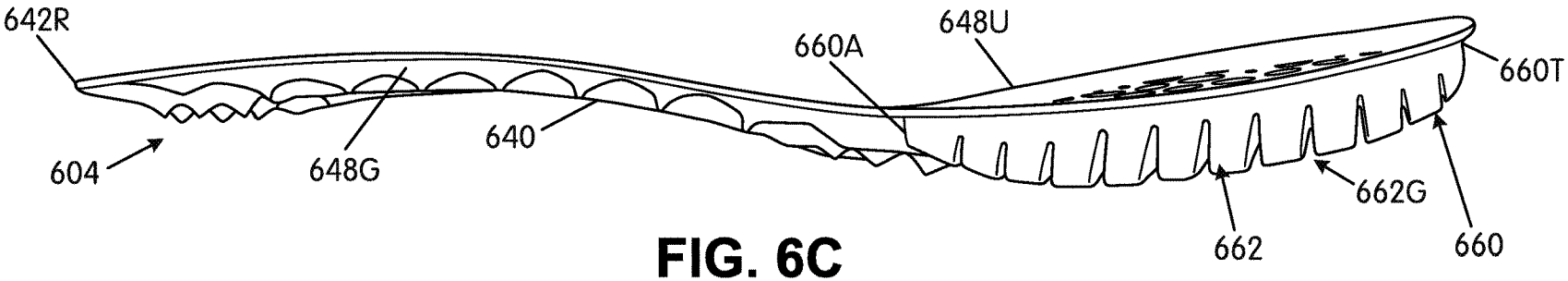
Figure 6D:
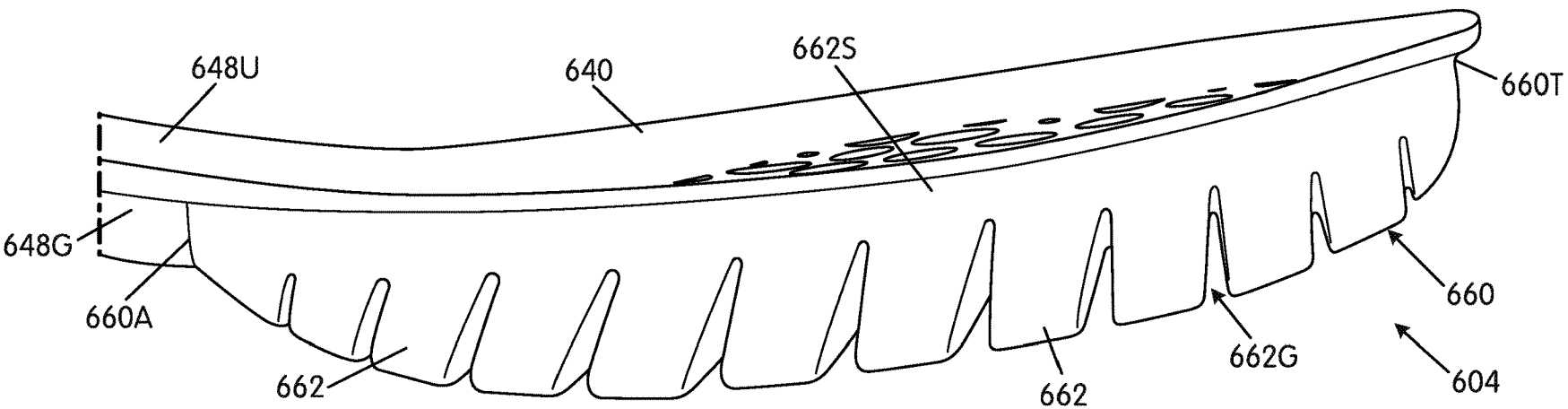

Features of this example ground-engaging component 640 for sole structures 604 now will be described in more detail with reference to FIGS. 6A-6G. As shown, this example ground-engaging component 640 includes an outer perimeter boundary rim 642O, for example, that may be at least 3 mm (0.12 inches) wide (and in some examples, is at least 4 mm (0.16 inches) wide, at least 6 mm (0.24 inches) wide, or even at least 8 mm (0.32 inches) wide). This "width," as described above with respect to FIG. 2B, is defined as the direct, shortest distance from one (e.g., exterior) edge of the outer perimeter boundary rim 642O to its opposite (e.g., interior) edge by the open space 644, as shown in FIG. 6B. While FIGS. 6A and 6B show this outer perimeter boundary rim 642O extending completely and continuously around the ground-engaging component 640, other options are possible. For example, if desired, there may be one or more breaks in the outer perimeter boundary rim 642O at the outer perimeter of the ground-engaging component 640 such that the outer perimeter boundary rim 642O is present around only at least 60%, at least 75%, at least 80%, at least 90%, or even at least 95% of the outer perimeter of the ground-engaging component 640. The outer perimeter boundary rim 642O may have a constant or changing width over the course of its perimeter. Alternatively, if desired, the outer perimeter boundary rim 642O may be interrupted by and/or terminate at the area of the forefoot edge support, as will be described in more detail below.

FIGS. 6A and 6B further show that the outer perimeter boundary rim 642O of the ground-engaging component 640 defines an open space 644 at least at a forefoot support area of the ground-engaging component 640, and in this illustrated example, the open space 644 extends into the arch support area and the heel support area of the ground-engaging component 640. The rearmost extent 642R of the outer perimeter boundary rim 642O of this example is located within the heel support area, and optionally at a rear heel support area of the ground-engaging component 640.

The outer perimeter boundary rim 642O of this illustrated example ground-engaging component 640 defines an upper-facing surface 648U and a ground-facing surface 648G opposite the upper-facing surface 648U. The upper-facing surface 648U provides a surface for supporting the wearer's foot and/or engaging the upper (and/or optionally engaging any present midsole component). The outer perimeter boundary rim 642O may provide a relatively large surface area for securely supporting at least a portion of (and optionally all of) a plantar surface of a wearer's foot. Further, the outer perimeter boundary rim 642O may provide a relatively large surface area for securely engaging another footwear component (such as the bottom surface of the upper), e.g., a surface for bonding via adhesives or cements, for supporting stitches or sewn seams, for supporting mechanical fasteners, etc.

FIGS. 6A-6B further illustrate that the ground-engaging component 640 of this example sole structure 604 includes a support structure 650 that extends from the outer perimeter boundary rim 642O into and at least partially across (and optionally completely across) the open space 644. The top surface of this example support structure 650 at locations within the open space 644 lies flush with and/or smoothly transitions into the outer perimeter boundary rim 642O to provide a portion of the upper-facing surface 648U (and may be used for the purposes of the upper-facing surface 648U as described above). This support structure 650 extends from the ground-facing surface 648G of the outer perimeter boundary rim 642O to define at least a portion of the ground-facing surface 648G of the ground-engaging component 640. This sole structure 604, including the support structure 650, may have any of the characteristics, options, features, etc., of the sole structure 204 described above in conjunction with FIGS. 2A-5H (including any features of the matrix structure 250). Accordingly, more detailed explanations of the potentially common features of sole structure 604 and/or support structure 650 are omitted.

One difference between the sole structure 604 of FIGS. 6A-6G and the sole structures 204 described above relates to the inclusion of a forefoot edge support 660 extending along and defining at least a portion of a forefoot edge of the ground-engaging component 640. As shown in FIGS. 6B, 6E, 6F, and 6G, a bottom surface 660S of the forefoot edge support 660 slants in an outward and downward direction from a location adjacent or within the open space 644 toward the outer forefoot edge of the ground-engaging component 640. The bottom surface 660S may be relatively flat or smoothly curved and may contact the ground in use. The slanted bottom surface 660S builds up the forefoot perimeter edge of the ground-engaging component 640 to provide additional support, e.g., when running curves on a track (and particularly if the curves are banked). For track events that run around an oval track in a counter-clockwise direction, the forefoot edge support 660 may be provided on the lateral side of the right shoe and/or on the medial side of the left shoe (as will be described in more detail below in conjunction with FIGS. 7A and 7B). As further shown in the figures, in this illustrated example, the forefoot edge support 660 terminates at one end 660T at a forward toe location (e.g., at P=0.9L to 1L, and in some examples, at P=0.95L to 1L, or even at P=0.98L to 1L) and at its other end 660A at or near an arch support area (e.g., at P=0.5L to 0.75L, and in some examples, at P=0.55L to 0.7L).

Further, as shown in FIGS. 6A and 6B, the bottom surface 660S of the forefoot edge support 660 may have a maximum width dimension "$W_s$" of less than 2.5 inches (6.35 cm) wide, and in some examples, less than 2 inches (5.1 cm) wide, less than 1.75 inches (4.45 cm) wide, or even less than 1.5 inches (3.81 cm) wide, measuring in the transverse direction, measuring outward from the open space, and/or measuring from the outside edge of the support structure 650. At its maximum width dimension $W_s$ location in the transverse direction, the forefoot edge support surface 660S may extend in the transverse direction for a distance less than a distance that the open space 644 and/or the support structure 650 extends at that same transverse direction location, e.g., the forefoot edge support 660 may extend less than ½ of the sole structure 604 width and/or less than ½ of the open area 644 width at the forefoot edge support 660's widest transverse dimension location). Additionally or alternatively, if desired, the forefoot edge support surface 660S may extend inward (into the open space 644) beyond the interior edge 642I of the outer perimeter boundary rim 642O and/or outward beyond the exterior edge 642E of the outer perimeter boundary rim 642O. At this widest maximum width dimension $W_s$ location, the bottom surface 660S of the forefoot edge support 660 may be at least 0.75 inches (1.9 cm) wide, and in some examples, at least 1 inch (2.54 cm) wide.

Figure 6E:
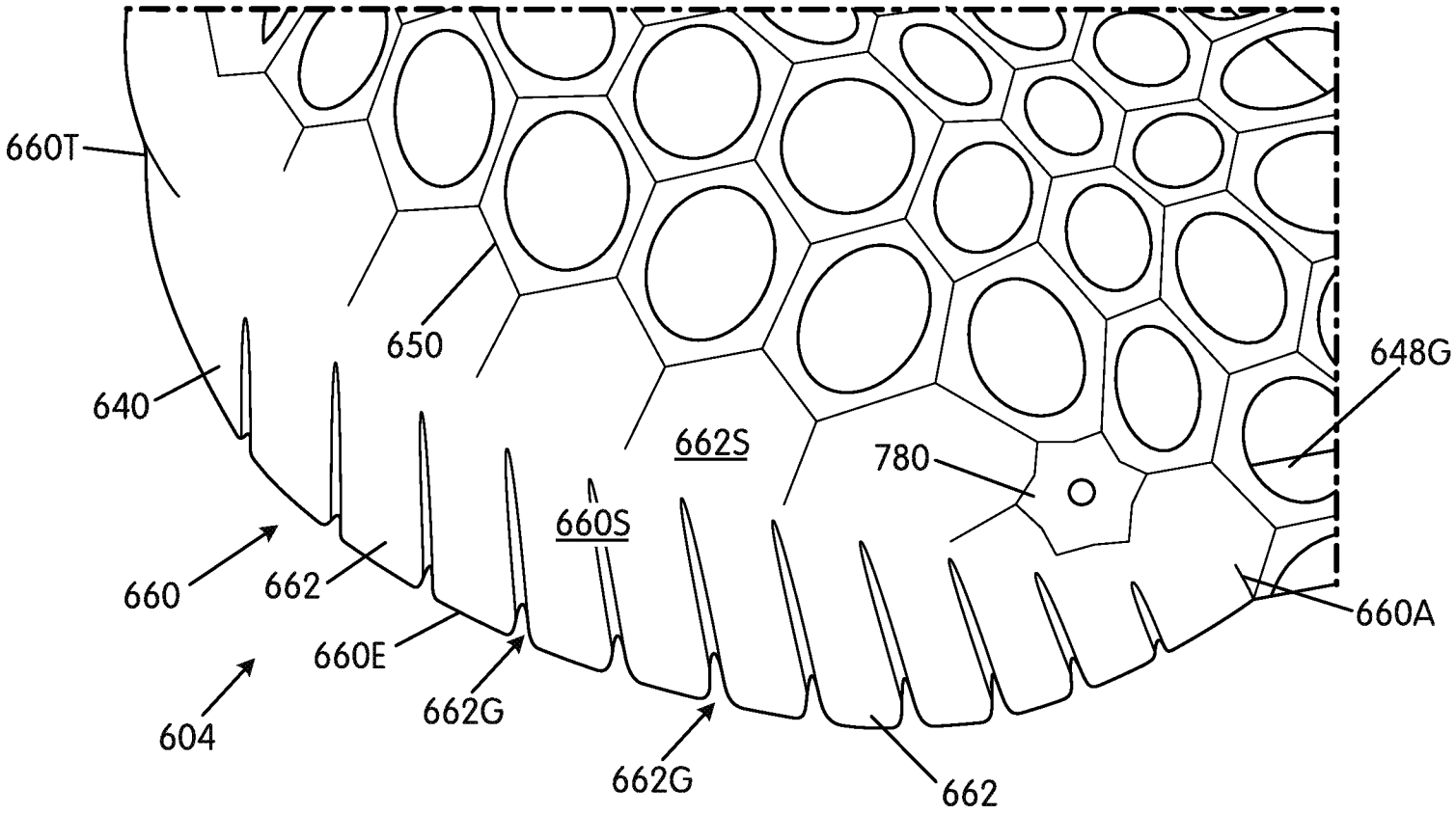
Figure 6F:
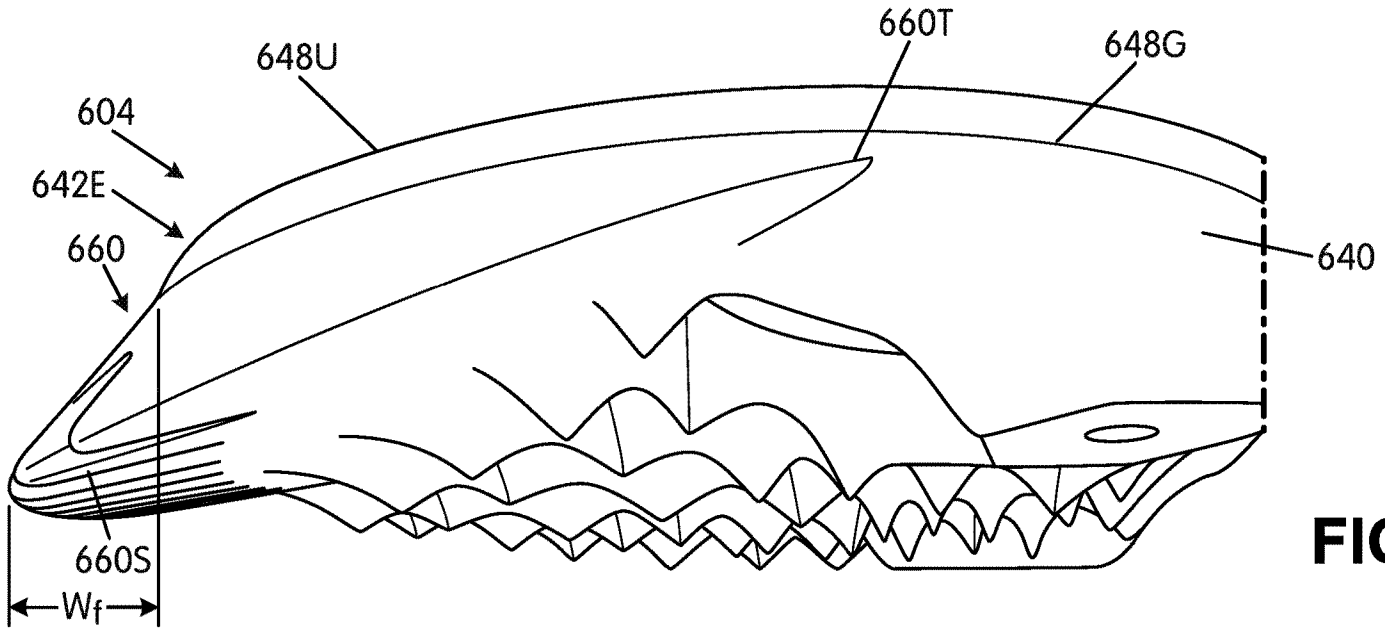
Figure 6G:
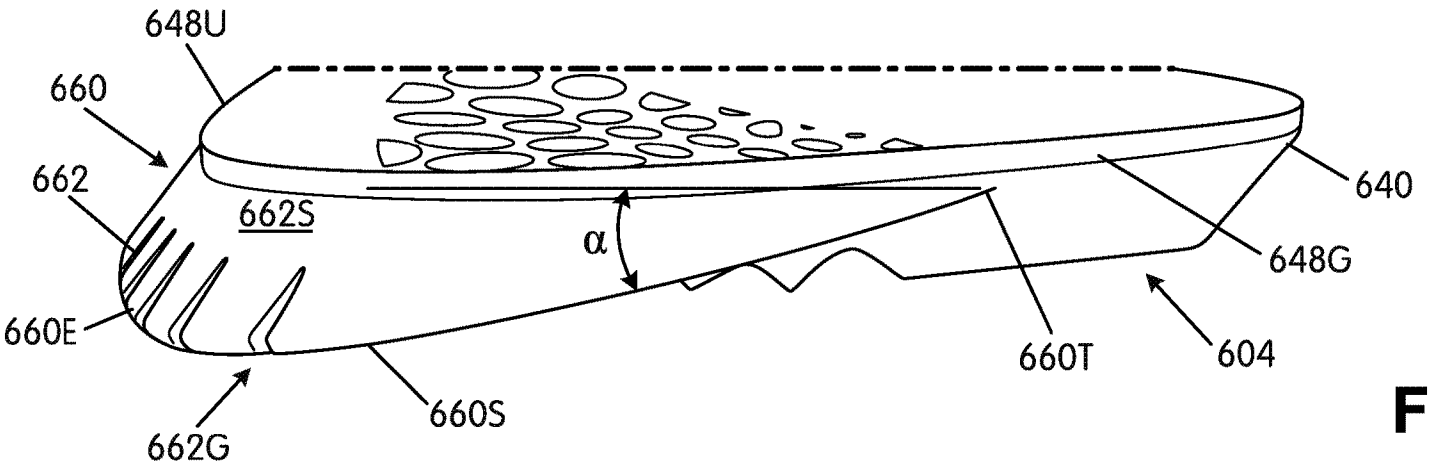

As shown in FIGS. 6A, 6F, and 6G, the exterior edge 642E of the outer perimeter boundary rim 642O may be located directly below a footwear upper's outer edge and/or at a location directly below (and provided to directly support) an outer forefoot edge of a wearer's foot (e.g., when the sole structure 604 is on a horizontal support surface). The forefoot edge support 660 may extend at least 0.5 inches (1.27 cm), at least 0.75 inches (1.9 cm), or even at least 1 inch (2.54 cm) outward from the outer edge of the upper and/or the exterior edge 642E of the outer perimeter boundary rim 642O (dimension $W_F$) at its maximum width location.

As noted above, the bottom surface 660S of the forefoot edge support 660 in this example slants in an outward and downward direction, e.g., from a location adjacent or within the open space 644 toward and to a location at or adjacent the outer forefoot edge of the ground-engaging component 640. Indeed, the forefoot edge support 660 may form the outer forefoot edge of the ground-engaging component 640 in at least some of the forefoot area. As shown in FIG. 6G, the slant angle α of at least some portions of the surface 660S (e.g., with respect to a horizontal plane or a base surface of the ground-engaging component 640) may be within a range of 2° to 12° downward, and in some examples, within the range of 3° to 10° downward or even 4° to 8° downward (e.g., at about 6°).

As further shown in FIGS. 6B, 6F, and 6G, the bottom surface 660S of the forefoot edge support 660 slants downward and outward over at least some (and optionally a majority or substantially all) of its width (e.g., from its base area 662S or origin at the open area defined by the outer perimeter boundary rim 642O to a location at or immediately adjacent its outermost edge 660E) at the angle α described above. The outermost edge 660E may include a rounded corner moving from bottom surface 660S to its exposed top surface, e.g., as shown in FIG. 6F. As also shown in FIGS. 6B, 6F, and 6G, the exposed top surface of the forefoot edge support 660 also slants downwardly and outwardly from the exterior edge 642E of the outer perimeter boundary rim 642O to the free, exposed edge 660E.

FIGS. 6A-6G further show that the forefoot edge support 660 of this example includes a plurality of edge support components 662 that extend to and define a free outer edge 660E of the forefoot edge support 660. While other arrangements and/or numbers of parts are possible, in this illustrated example, the plurality of edge support components 662 are interconnected at their interior side and/or upper side by base surface 662S and are separated from one another at their exterior side and/or bottom side by gaps 662G. At their outermost locations, the gaps 662G between adjacent edge support components 662 may have any desired size. As some more specific examples, at their outermost locations (at edge 660E) and with the sole structure 604 in an unloaded condition, the gaps 662G may have any one or more of the following properties: at least 0.1 mm (0.004 inch) wide, at least 0.5 mm (0.02 inch) wide, less than 12 mm (0.47 inch) wide, less than 8 mm (0.32 inch) wide, less than 5 mm (0.20 inch) wide, or even less than 3 mm (0.12 inch) wide. Providing the gaps 662G and separating at least portions of the forefoot edge support 660 into components 662 helps improve the flexibility and reduce the weight of the sole structure 604 and improves the natural motion capabilities of the sole structure 604. Alternatively, if desired, one or more of the edge support components 662 may be separate structures from one or more other of the edge support components 662 (e.g., the interconnecting base surface 662S can be omitted over at least some of the length of forefoot edge support 660 and/or at least some (and optionally all) of the edge support components 662 may extend from the outer perimeter boundary rim 642O and/or the support structure 650).

The forefoot edge support 660 may extend downward from the ground-facing surface 648G of the outer perimeter boundary rim 642O. As some additional or alternative potential features, e.g., as shown in FIG. 6A, the outer perimeter boundary rim 642O may define an exterior perimeter edge 642E and an interior perimeter edge 642I, and the forefoot edge support 660 may extend from the open space 644 and/or support structure 650 from a location inside the interior perimeter edge 642I and/or to a location beyond the exterior perimeter edge 642E. Alternatively, if desired, the forefoot edge support 660 may replace a portion of the outer perimeter boundary rim 642O and/or smoothly morph to form the outer perimeter boundary rim 642O at the forefoot area. Also, as shown in FIGS. 6B and 6E, the support structure 650 may extend to and/or morph into the forefoot edge support 660 (e.g., morph into surface 660S and/or 662S).

In the example sole structure 604 shown in FIGS. 6A-6G, the sole structure 604 is a sole structure for inclusion in a right shoe (with the forefoot edge support 660 located at the forefoot lateral side of the sole structure 604). This sole structure 604 may be well adapted for use in a right track shoe, and particularly for running events run in a counterclockwise direction around an oval track (optionally a banked track). The forefoot edge support 660 provides an angled base surface 660S that engages the curves and/or banks and helps the wearer (who will typically lean left while running the curves) better push off the track surface (e.g., making the push off in more of a normal direction with respect to the track surface). If desired, the inside/left shoe (e.g., to be paired with an outside/right shoe including sole structure 604) need not have a lateral side forefoot edge support like support 660. As some more specific examples, if desired, the inside/left shoe may have sole structures like those described above in conjunction with FIGS. 2A-5H (e.g., sole structures 204).

Figure 7A:
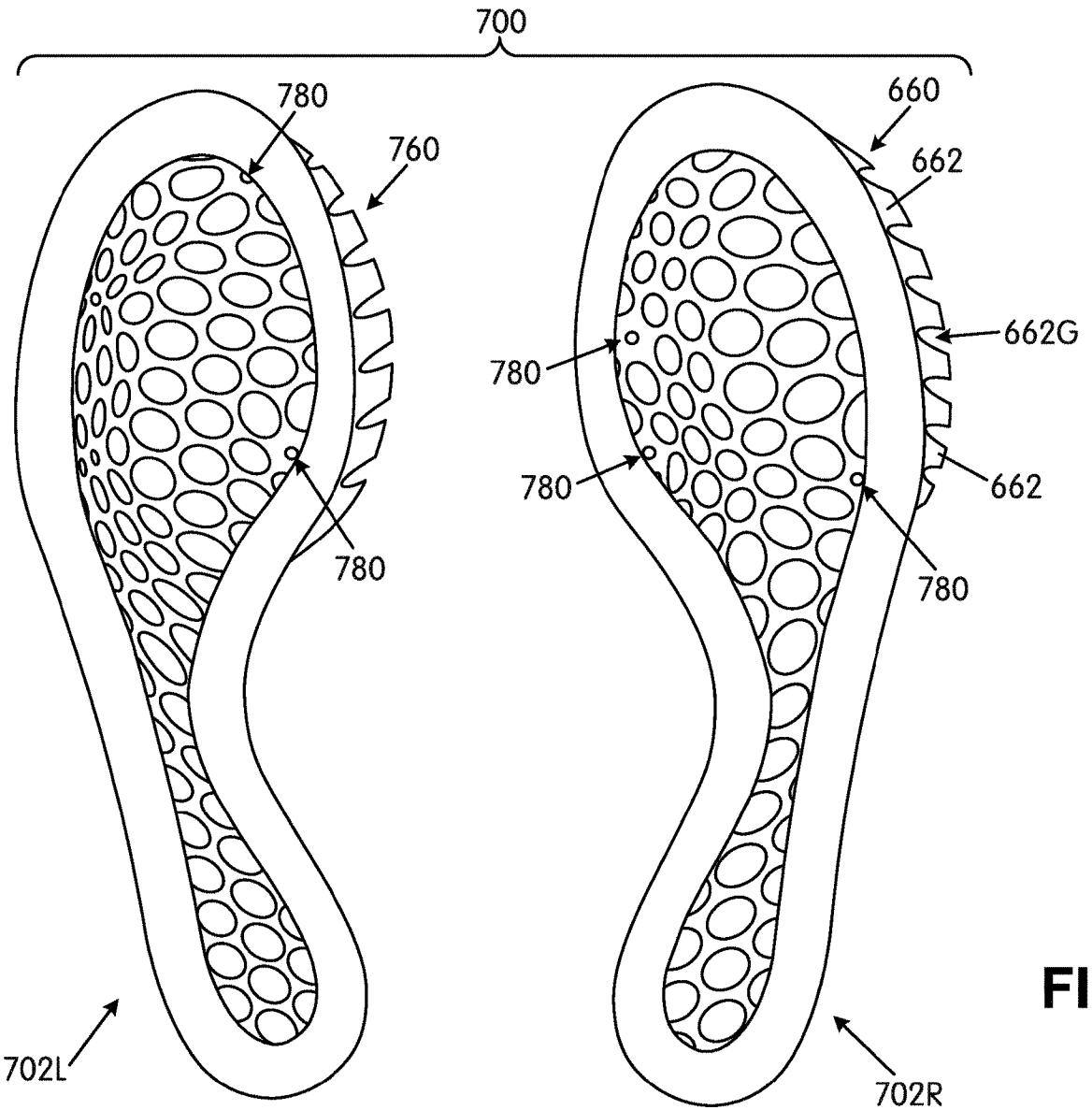
FIGS. 7A and 7B provide views illustrating example features of a pair of shoes in accordance with other aspects of this invention.
Figure 7B:
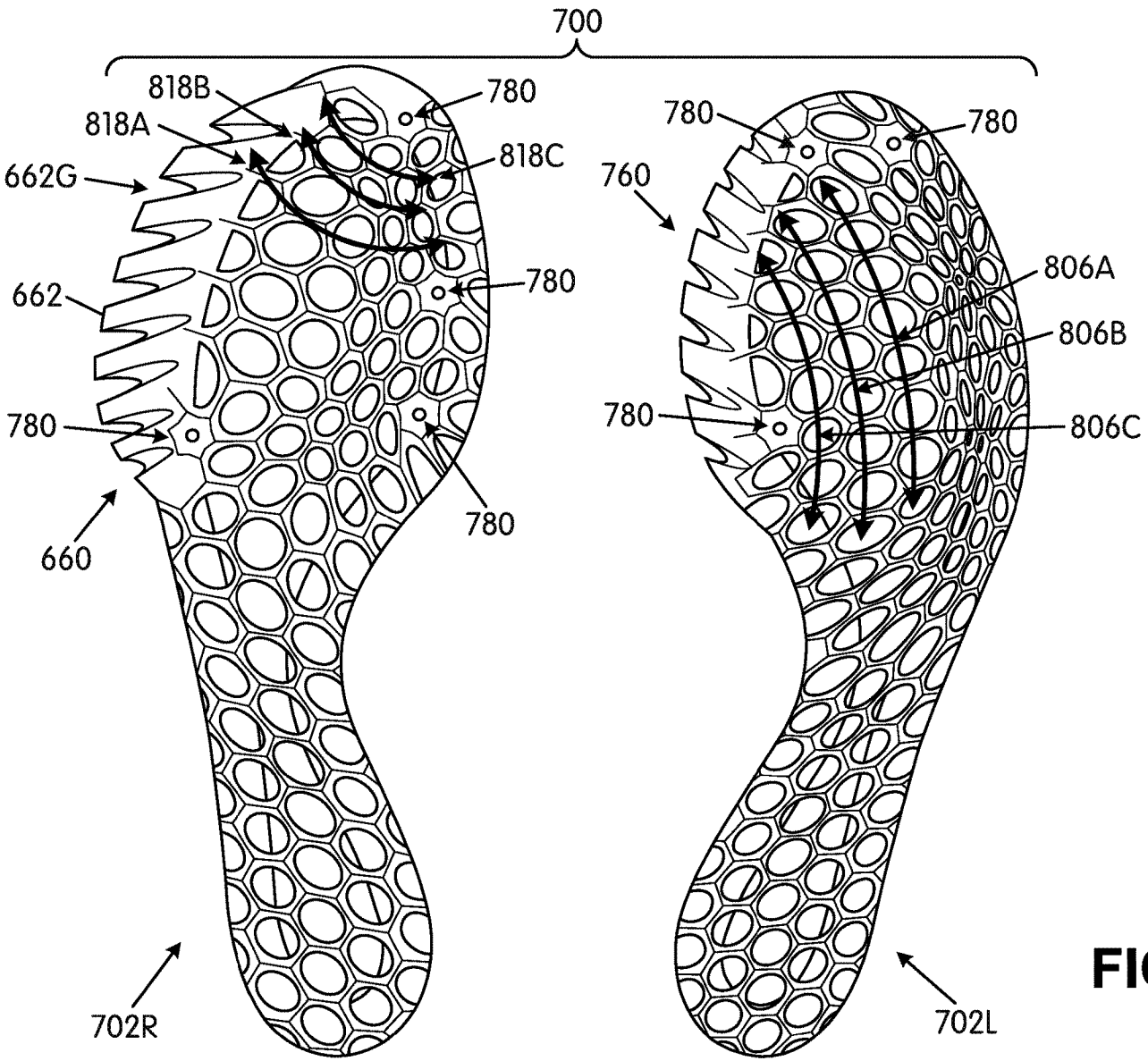

As another option, if desired, sole structure 604 may be paired with a left shoe that also has a forefoot edge support. FIGS. 7A and 7B illustrate a top view and a bottom view, respectively, of one example of a pair 700 of sole structures 702R and 702L for such a pair of shoes. If desired, in this sole structure pair 700, the right sole structure 702R may have any of the structures, features, and/or options described above with respect to sole structures 204 and/or 604 and FIGS. 2A-6G. In the illustrated example, however, the forefoot edge support 660 of sole structure 702R has somewhat fewer edge support components 662 and the edge support components 662 are generally separated from one another by somewhat larger gaps 662G as compared to the sole structure 604 shown in FIGS. 6A-6G. While any desired numbers of edge support components 662 may be provided (e.g., from 4 to 24), in the example of FIGS. 6A-6G, 12 edge support components 662 are shown, while in the example of FIGS. 7A and 7B, 8 edge support components 662 are shown.

FIGS. 7A and 7B further show that the left sole structure 702L in this example includes a forefoot edge support 760 located at the medial forefoot side of the sole structure 702L. The left sole structure 702L forefoot edge support 760 may have any of the structural features, sizes, orientations, arrangements, and/or options discussed above with respect to the edge support 660 of FIGS. 6A-6G, but the forefoot edge support 760 is provided on the medial forefoot side of the sole structure 702L rather than on the lateral side. This sole structure 702L, particularly when combined with one of the sole structures 604, 702R shown in FIGS. 6A-7B, may be well adapted for use in a left track shoe, and particularly for running events in a counter-clockwise direction around an oval and/or banked track (e.g., such as the 200 m, 400 m, 800 m, etc.). The forefoot edge support 760 provides an angled bottom surface (e.g., like surface 660S) that engages the track surface (e.g., banks) on the track's curves and helps the wearer better steer and push off the track surface. If desired, the right shoe (e.g., to be paired with a left shoe including sole structure 702L) need not have a forefoot edge support of the types described above.

Accordingly, the example sole structures 702L and 702R shown in FIGS. 7A and 7B have an "asymmetric" construction in that the right and left sole structures are not mirror images of one another. Differences in the locations and/or other properties of the forefoot edge supports 660, 760, however, are not necessarily the only areas of difference in mirror image symmetry between the left sole structure 702L and right sole structure 702R in this example. For example, in this illustrated example sole structure pair 700, the cleat mount areas 780 on the left sole structure 702L do not constitute mirror images of the cleat mount areas 780 on the right sole structure 702R. The cleat mount areas 780 may be structures for engaging a detachable cleat or they may be locations accommodating permanently mounted primary cleat elements, e.g., of the types described above.

More specifically, as shown in FIGS. 7A and 7B, in the sole structure 702R, four primary cleat mount areas 780 are provided, with three along the medial side edge in the forefoot and/or arch area and one on the lateral side edge in the forefoot and/or arch area. The rearmost cleat mount area 780 on the medial side and the cleat mount area 780 on the lateral side of sole structure 702R may be at substantially the same location along the longitudinal direction of the sole structure 702R (e.g., generally beneath the first and fifth metatarsal head support areas). The two forward medial side cleat support mount areas 780 of this example are located beneath the first metatarsal and/or toe support areas. If desired, the cleat mount areas 780 may be at the locations described above with respect to FIG. 3A (and/or those described in more detail below with respect to FIG. 8B). At these locations, the cleat support mount areas 780 (and any primary cleats engaged therewith) on the right sole structure 702R (e.g., for the "drive foot" on a curved track) provide support and traction to prevent sideways sliding and/or a strong "push off" during the toe off phase of a step cycle when running a counter-clockwise curve.

The illustrated example left sole structure 702L, on the other hand, includes three primary cleat mount areas 780, with two along the medial side edge in the forefoot and/or arch area and one on the lateral side edge in the forefoot and/or toe area. The rearmost cleat mount area 780 on the medial side is located beneath the first metatarsal head support area. The two forward cleat mount areas 780 of this example sole structure 702L are located at the forward toe area. At these locations, the cleat mount areas 780 (and any primary cleats engaged therewith) on the left sole structure 702L (e.g., for the "steering foot" on a curved track) provide support and traction to enable better control or steering during the step cycle, particularly when running a counter-clockwise curve. The cleat mount areas 780 of this sole structure 702L may be at any of the locations described above with respect to FIG. 3A (and/or those described in more detail below with respect to FIG. 8A). In the specific example of FIG. 7B, the rearward medial primary traction element is located at about 0.67L and the two forward primary traction elements are located at about 0.9L. The rearward primary traction element may be the only primary traction element located between P=0.5L and P=0.8L.

The cleat mount areas 780 provided in the examples of FIGS. 6A-7B may have any of the structural features, sizes, orientations, arrangements, and/or options discussed above with respect to FIGS. 2A-5H, including the location features, the hexagonal type construction features, and/or the secondary traction element features.

Figure 8A:
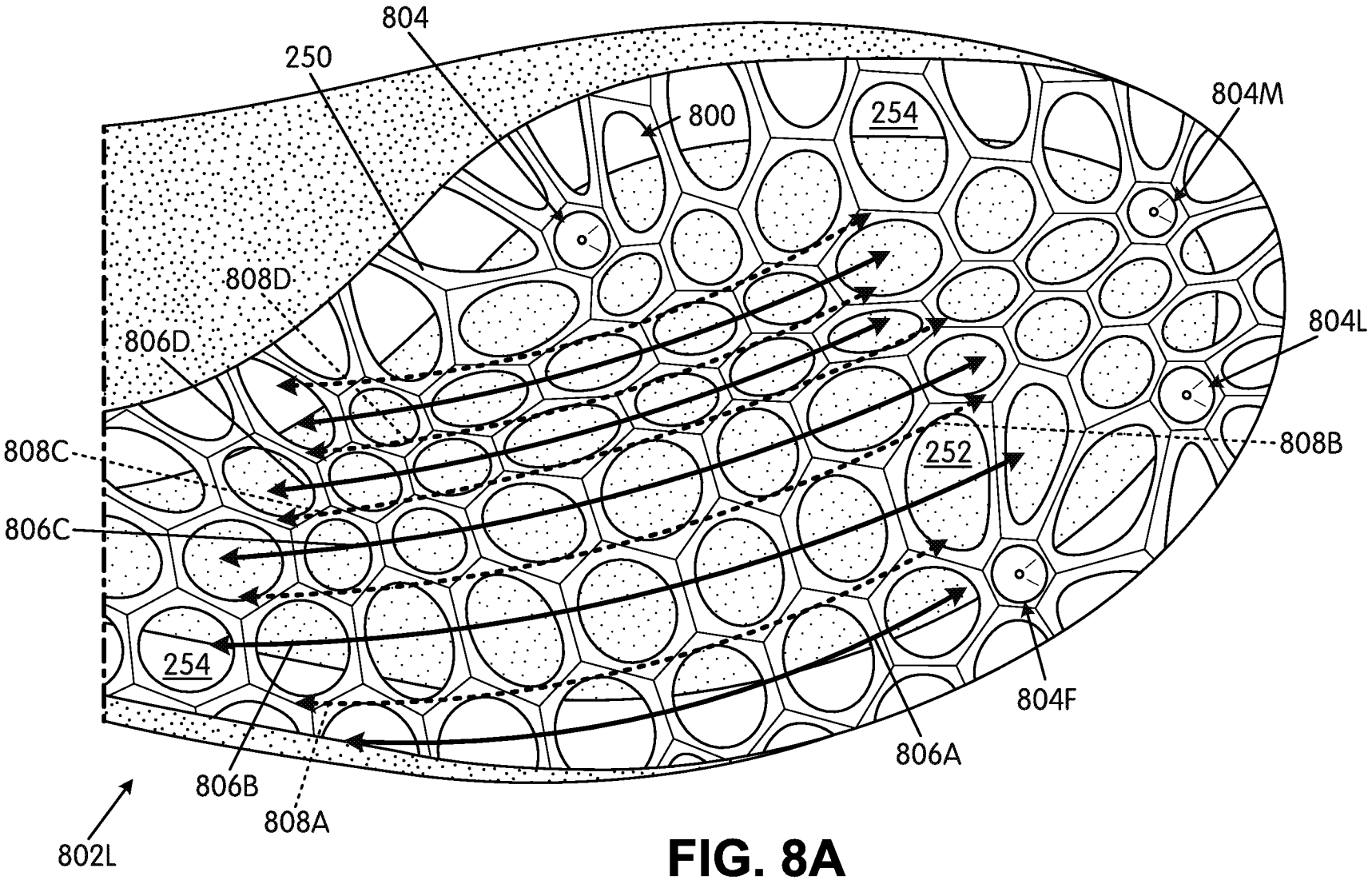
FIGS. 8A and 8B provide views of a forefoot area of left and right ground-engaging components that illustrate additional features that may be provided in footwear structures in accordance with at least some examples of this invention.
Figure 8B:
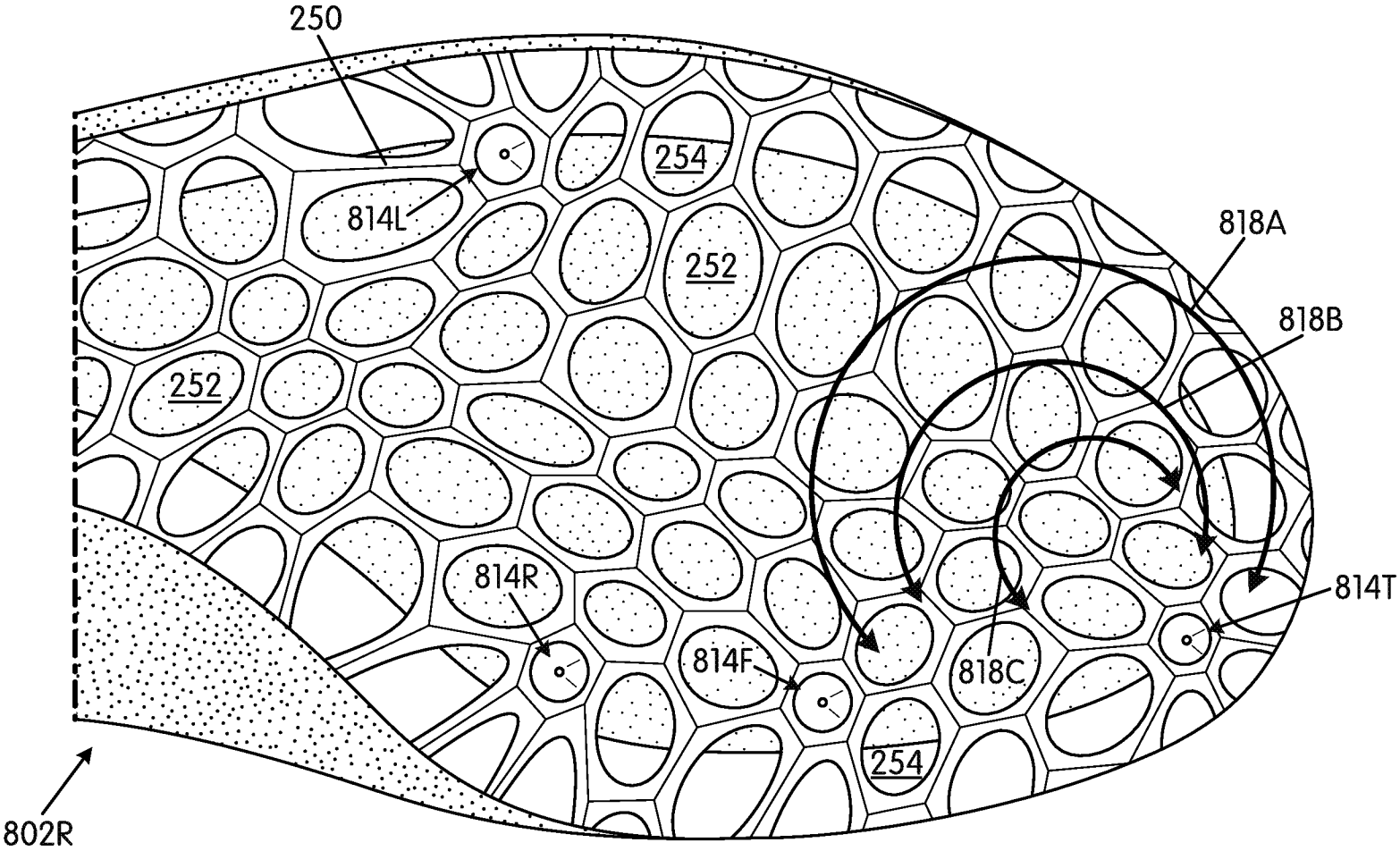

FIGS. 8A and 8B illustrate directional traction element features that may be included in ground-engaging components and/or articles of footwear in accordance with some aspects of this invention, including in any of the examples of this invention described above (e.g., in conjunction with any of the structures described above relating to FIGS. 2A-7B). FIG. 8A illustrates a forefoot area of a ground-engaging component 802L for an inside foot with respect to running around a curved track (e.g., for a left foot and for use on a conventional track running counter-clockwise), and FIG. 8B illustrates a forefoot area of a ground-engaging component 802R for an outside foot with respect to running around a curved track (e.g., for a right foot and for use on a conventional track running counter-clockwise).

When running around a curve on a track, the inside (e.g., left) leg/foot typically is the steering leg/foot, and the outside (e.g., right) leg/foot typically is the drive leg/foot. When running the curve, the inside/left foot plants early in the step cycle, and stance and rotation occur off the spike(s) of the ground-engaging component located beneath the ball area at the medial side of the foot. To better support this rotation (e.g., about arrow 800 of FIG. 8A), this example ground-engaging component 802L includes one primary traction element 804 (e.g., track spike) located on its medial side and no primary traction element(s) located in that same general longitudinal area of the ground-engaging component 802L, e.g., at the lateral side, between the medial and lateral sides, etc. The absence of primary traction elements at the central and lateral side of the ground-engaging component 802L at this longitudinal area better allow and facilitate this rotation. If desired, the primary traction element 804 may be located along the longitudinal direction of the ground-engaging component 802L (and/or a sole structure or article of footwear containing ground-engaging component 802L) between planes perpendicular to the longitudinal direction and located at 0.55L and 0.75L (and in some examples, between perpendicular planes located at 0.6L and 0.7L). This primary traction element 804, located adjacent the medial side edge of the ground-engaging component 802L, may be the only primary traction element located between perpendicular planes located at 0.6L and 0.75L (and in some examples, the only primary traction element between perpendicular planes located at 0.6L and 0.7L).

As further shown by the arrows 806A-806D in FIG. 8A, the cells 252/254 in the matrix structure 250 are arranged generally in arcs around the primary traction element 804 to facilitate foot rotation about the primary traction element 804. More specifically, as shown in FIG. 8A, a lateral side edge of the matrix structure 250 includes a plurality of cells 252/254 (e.g., at least three cells 252/254, and optionally, at least three adjacent cells 252/254) having their geographic centers lying substantially along curved arrow 806A, which may correspond to an arc of a circle (or other desired curve). If desired, this set of cells 252/254 along curved arrow 806A may be an outermost set of cells 252/254 along the lateral forefoot edge of the ground-engaging component 802L. Inside arrow 806A, another set of cells 252/254 having their geographic centers lying substantially along curved arrow 806B is provided (and the cells 252/254 along arrow 806A lie immediately adjacent the cells 252/254 along arrow 806B, in this illustrated example). Similarly, inside arrow 806B, another set of cells 252/254 having their geographic centers lying substantially along curved arrow 806C is provided (and the cells 252/254 along arrow 806B lie immediately adjacent the cells 252/254 along arrow 806C, in this illustrated example), and inside arrow 806C, another set of cells 252/254 having their geographic centers lying substantially along curved arrow 806D is provided (and the cells 252/254 along arrow 806C lie immediately adjacent the cells 252/254 along arrow 806D, in this illustrated example). More or fewer arcs 806A-806D (or other curves) of cells 252/254 may be arranged in this manner, if desired, without departing from this invention. While not a requirement, if desired, the arcs (or other curves) defined by two or more of arrows 806A-806D (or any additional corresponding groups of cells 252/254) may have the same radius of curvature and/or may be concentric. A cell 252/254 is considered to lie "substantially along" an arc or other curve (e.g., a parabolic curve, an elliptical curve, an oval curve, or other standard curve, etc.) if its geographic center is located within 5 mm of the arc or other curve. Any desired number of arcs or other curves of cells 252/254 may be provided around primary traction element 804 without departing from this invention (e.g., from 2-10 arcs or other curves, and in some examples, from 3-8 arcs or other curves). As shown in FIG. 8A, the primary traction element 804 may be arranged inside (or on a concave side) of the arcs (or other curves) 806A-806D along which the cells 252/254 are substantially aligned.

In this forefoot area, secondary traction elements may be provided, e.g., at the corners of the generally hexagonal (or other polygonal shaped) matrix structure 250 that define the cells 252/254 at the ground-facing surface of the matrix 250, e.g., in the manners described above in conjunction with FIGS. 5A-5H. The arc (or other curved) arrangement of cells 252/254 (e.g., along arrows 806A-806D as described above) may, in turn, provide clusters or groups of secondary traction elements arranged along arcs or other curves that generally curve in the same manner as arrows 806A-806D, as shown by arrows 808A-808D in FIG. 8A. More or fewer arcs (or other curves) 808A-808D of grouped secondary traction elements may be arranged in this manner, if desired, without departing from this invention. If desired, the arcs or other curves defined by two or more arrows 808A-808D (or any additional groups of secondary traction elements) may have the same radius of curvature and/or may be concentric. A secondary traction element is considered to lie "substantially along" an arc or other curve if its peak (or ground-engaging point or surface) is located within 5 mm of the arc or other curve. As shown in FIG. 8A, the primary traction element 804 may be arranged inside (or on a concave side) of the arcs (or other curves) 808A-808D along which the secondary traction elements are substantially aligned.

The example ground-engaging component 802L of FIG. 8A further includes two forward toe based primary traction elements 804L and 804M and a third forefoot primary traction element 804F located along the lateral side edge of the ground-engaging component 802L just rearward of primary traction element 804L. These primary traction elements 804F, 804L, and 804M provide traction for the toe-off phase of the step cycle. These primary traction elements 804F, 804L, and 804M may be located sufficiently forward from primary traction element 804 so as not to interfere (or not to substantially interfere) with rotation about primary traction element 804 as described above. As some more specific examples, the primary traction elements 804F, 804L, and 804M (and optionally all forefoot based primary traction elements other than element 804) may be located forward of a plane perpendicular to the longitudinal direction of the ground-engaging component 802L (or the longitudinal direction of a sole structure or an article of footwear) located at 0.8L and optionally, forward of a perpendicular plane located at 0.85L.

FIG. 8B illustrates example features of the outside (e.g., right) ground-engaging component 802R (e.g., for the drive leg/foot) when running around a curve on a track. In contrast to the inside foot, as described above, when running the curve, the outside/right foot rotates later in the step cycle, and stance and rotation occur off more forward spike(s) of the ground-engaging component (e.g., forward-most primary traction element 814T in FIG. 8B). To better support this rotation, this example ground-engaging component 802R includes one primary traction element 814T (e.g., track spike) located on its medial side at the forward toe area and no primary traction element(s) located in that same general longitudinal area of the ground-engaging component 802R, e.g., at the lateral side of the forward toe area, etc. The absence of primary traction elements at the lateral side of the forward toe area of this example ground-engaging component 802R at this longitudinal area better allow and facilitate this rotation. If desired, the primary traction element 814T may be located along the longitudinal direction of the ground-engaging component 802R (and/or a sole structure or article of footwear containing ground-engaging component 802R) forward of a plane perpendicular to the longitudinal direction and located at 0.85L (and in some examples, forward of a perpendicular plane located at 0.9L). This primary traction element 814T, located adjacent the medial side edge of ground-engaging component 804R, may be the only primary traction element located forward of a perpendicular plane located at 0.85L (and in some examples, the only primary traction element forward of a perpendicular plane located at 0.9L).

The example of FIG. 8B further shows other primary traction elements located rearward of primary traction element 814T, namely, a lateral side primary traction element 814L, a rearward medial side primary traction element 814R and a forward medial side primary traction element 814F. These primary traction elements 814L, 814R, and 814F may be located sufficiently rearward so as not to interfere (or not to substantially interfere) with rotation about primary traction element 814T as described above (and as will be described in more detail below). As some more specific examples, some or all of the primary traction elements 814L, 814R, and 814F may be located rearward of a plane perpendicular to the longitudinal direction of the ground-engaging component 802R (or the longitudinal direction of a sole structure or an article of footwear containing it) and located at 0.85L (and optionally, rearward of a perpendicular plane located at 0.8L). Additionally or alternatively, if desired, the primary traction elements 814L, 814R, and 814F may be located between perpendicular planes located at 0.6L and 0.85L (and, if desired, the rearmost primary traction elements 814L and 814R may be located between perpendicular planes located at 0.6L and 0.75L). The three medial side primary traction elements 814T, 814F, and 814R provide substantial traction for the toe off phase of the step cycle.

As further shown by the arrows 818A-818C in FIG. 8B, the cells 252/254 in the matrix structure 250 of this ground-engaging component 802R are arranged generally in arcs (or other curves, such as parabolic curves, elliptical curves, oval curves, other standard curves, etc.) around the primary traction element 814T to facilitate the desired foot rotation about the primary traction element 814T. More specifically, as shown in FIG. 8B, a lateral side of the matrix structure 250 includes a plurality of cells 252/254 (e.g., at least three cells 252/254, and optionally, at least three adjacent cells 252/254) arranged such that a substantial number of secondary traction elements are oriented on arcs or other curves, e.g., 818A, 818B, 818C. As described above, secondary traction element features may be formed at the corners of the generally hexagonal (or other polygonal shaped) matrix structure 250 that define the cells 252/254 at the ground-facing surface of the matrix 250, e.g., in the manners described above in conjunction with FIGS. 5A-5H. The arc or other curved arrangement of some of these secondary traction elements (e.g., along arcs 818A-818C as described above) provides generally grouped secondary traction elements. More or fewer arcs or other curves 818A-818C of grouped secondary traction elements may be arranged in this manner, if desired, without departing from this invention. If desired, each of arcs or other curves 818A-818C (and any other present groups) may include at least 6 secondary traction elements that lie "substantially along" it (and in some examples, the arcs or other curves each may include at least 8, at least 10, at least 12, or even at least 15 secondary traction elements that lie "substantially along" it). These generally arc or curve arranged clusters or groups of secondary traction elements (e.g., along arcs 818A-818C) facilitate the late stage rotation of the foot about primary traction element 814T, as described above. If desired, the arcs or curves defined by two or more of arrows 818A-818C (or any additional arcs or curves) may have the same radius of curvature and/or may be concentric. As shown in FIG. 8B, the primary traction element 814T may be arranged inside (or on a concave side) of the arcs (or other curves) 818A-818C along which the secondary traction elements are substantially aligned.

Each of the specific "perpendicular plane" locations and/or ranges described above in conjunction with FIGS. 8A and 8B refers to any one or more of (a) locations along the longitudinal length of the respective ground-engaging component 802L or 802R, (b) locations along the longitudinal length of a sole structure (e.g., in which the respective ground-engaging component 802L or 802R is contained), and/or (c) locations along the longitudinal length of an article of footwear (e.g., in which the respective ground-engaging component 802L or 802R is contained). Also, the directional traction features and/or other features of the ground-engaging components 802L and/or 802R may be used in conjunction with any of the footwear structures and/or features described above with respect to FIGS. 2A-7B (note, for example, the similar arrows shown in FIG. 7B).

II. CONCLUSION

The present invention is disclosed above and in the accompanying drawings with reference to a variety of embodiments and/or options. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

What is claimed is:

1. A ground-engaging component for an article of footwear, the ground-engaging component comprising:

an outer perimeter boundary rim that at least partially defines an outer perimeter of the ground-engaging component, wherein the outer perimeter boundary rim defines an upper-facing surface and a ground-facing surface opposite the upper-facing surface, and wherein the outer perimeter boundary rim comprises an exterior perimeter edge and an interior perimeter edge, wherein the interior perimeter edge defines an open space extending completely through the ground-engaging component at least at a forefoot support area of the ground-engaging component; and a forefoot edge support extending along and defining at least a portion of a first forefoot edge of the ground-engaging component, wherein the forefoot edge support includes a bottom surface that slants in an outward and downward direction over a majority of a width of the bottom surface of the forefoot edge support from a location inside the interior perimeter edge of the outer perimeter boundary rim to the first forefoot edge, wherein the first forefoot edge is an outermost forefoot side edge of the ground-engaging component, wherein the forefoot edge support includes a plurality of edge support components defining the outermost forefoot side edge of the ground-engaging component, and wherein the plurality of edge support components are defined by a plurality of gaps that are located in the bottom surface, the plurality of gaps extending to the outermost forefoot side edge such that the plurality of edge support components and the plurality of gaps together define the outermost forefoot side edge, wherein the ground-engaging component defines a longitudinal direction and a longitudinal length L extending from a rear-most heel location of the ground-engaging component to a forward-most toe location of the ground-engaging component, wherein the forefoot edge support terminates at a first end between planes perpendicular to the longitudinal direction and located at 0.9L and 1.0L measured forward from the rear-most heel location, and wherein the forefoot edge support terminates at a second end opposite the first end between planes perpendicular to the longitudinal direction and located at 0.5L and 0.75L measured forward from the rear-most heel location.

2. The ground-engaging component according to claim 1, wherein the forefoot edge support is provided only on a lateral forefoot side edge of the ground-engaging component or only on a medial forefoot side edge of the ground-engaging component.

3. The ground-engaging component according to claim 1, wherein the ground-engaging component constitutes a right shoe ground-engaging component, and wherein the forefoot edge support is provided only on a lateral forefoot side edge of the ground-engaging component.

4. The ground-engaging component according to claim 1, wherein the ground-engaging component constitutes a left shoe ground-engaging component, and wherein the forefoot edge support is provided only on a medial forefoot side edge of the ground-engaging component.

5. The ground-engaging component according to claim 1, wherein the forefoot edge support includes a base area, and wherein at least some of the plurality of edge support components extend to the outermost forefoot side edge from the base area.

6. The ground-engaging component according to claim 1, wherein at the outermost forefoot side edge, at least some of the plurality of gaps are each less than 8 mm wide.

7. The ground-engaging component according to claim 1, further comprising:

a matrix structure extending from the ground-facing surface and at least partially across the open space at least at the forefoot support area to define an open cellular construction with plural open cells across the open space at least at the forefoot support area, wherein the plural open cells are through hole openings extending in a direction from the ground-facing surface to the upper-facing surface of the outer perimeter boundary rim.

8. The ground-engaging component according to claim 1, wherein the outer perimeter boundary rim is at least 4 mm wide, and wherein the outer perimeter boundary rim is present around at least 60% of the outer perimeter of the ground-engaging component.

9. The ground-engaging component according to claim 1, wherein the forefoot edge support terminates at the first end between planes perpendicular to the longitudinal direction and located at 0.95L and 1.0L measured forward from the rear-most heel location.

10. The ground-engaging component according to claim 1, wherein the forefoot edge support terminates at the second end between planes perpendicular to the longitudinal direction and located at 0.55L and 0.7L measured forward from the rear-most heel location.

11. The ground-engaging component according to claim 1, wherein the forefoot edge support terminates at the first end between planes perpendicular to the longitudinal direction and located at 0.95L and 1.0L measured forward from the rear-most heel location and at the second end between planes perpendicular to the longitudinal direction and located at 0.55L and 0.7L measured forward from the rear-most heel location.

12. An article of footwear, comprising:

an upper; and a sole structure including a ground-engaging component according to claim 1 engaged with the upper.

13. The article of footwear according to claim 12, wherein the sole structure consists essentially of the ground-engaging component and/or wherein the upper-facing surface of the ground-engaging support component is directly engaged with the upper.

14. The ground-engaging component according to claim 1, wherein the plurality of edge support components includes from 4 to 24 edge support components, and wherein at the outermost forefoot side edge, the plurality of gaps are each less than 5 mm wide.

15. The ground-engaging component according to claim 1, wherein the plurality of edge support components are interconnected by a base surface located adjacent the open space.

16. A pair of shoes, comprising:

a first shoe, including a first upper and a first ground-engaging component engaged with the first upper, wherein the first ground-engaging component includes:

(a) a first outer perimeter boundary rim that at least partially defines a first outer perimeter of the first ground-engaging component, wherein the first outer perimeter boundary rim defines a first upper-facing surface and a first ground-facing surface opposite the first upper-facing surface, and wherein the first outer perimeter boundary rim comprises a first exterior perimeter edge and a first interior perimeter edge, wherein the first interior perimeter edge defines a first open space extending completely through the first ground-engaging component at least at a forefoot support area of the first ground-engaging component, and (b) a lateral side forefoot edge support extending along and defining at least a portion of a lateral forefoot edge of the first ground-engaging component, wherein the lateral side forefoot edge support includes a bottom surface that slants in an outward and downward direction over a majority of a width of the bottom surface of the lateral side forefoot edge support from the first open space to the lateral forefoot edge, wherein the lateral forefoot edge is an outermost lateral forefoot side edge of the first ground-engaging component, wherein the lateral side forefoot edge support includes a plurality of lateral edge support components defining the outermost lateral forefoot side edge of the first ground-engaging component, wherein the plurality of lateral edge support components are defined by a plurality of gaps that are located in the bottom surface of the lateral side forefoot edge support, the plurality of gaps extending to the outermost lateral forefoot side edge such that the plurality of lateral edge support components and the plurality of gaps together define the outermost lateral forefoot side edge, wherein the first ground-engaging component defines a first longitudinal direction and a first longitudinal length L extending from a rear-most heel location of the first ground-engaging component to a forward-most toe location of the first ground-engaging component, wherein the lateral side forefoot edge support terminates at a first end between planes perpendicular to the first longitudinal direction and located at 0.9L and 1.0L measured forward from the rear-most heel location of the first ground-engaging component, and wherein the lateral side forefoot edge support terminates at a second end opposite the first end between planes perpendicular to the first longitudinal direction and located at 0.5L and 0.75L measured forward from the rear-most heel location of the first ground-engaging component; and a second shoe, including a second upper and a second ground-engaging component engaged with the second upper, wherein the second ground-engaging component includes:

(a) a second outer perimeter boundary rim that at least partially defines a second outer perimeter of the second ground-engaging component, wherein the second outer perimeter boundary rim defines a second upper-facing surface and a second ground-facing surface opposite the second upper-facing surface, and wherein the second outer perimeter boundary rim comprises a second exterior perimeter edge and a second interior perimeter edge, wherein the second interior perimeter edge defines a second open space extending completely through the second ground-engaging component at least at a forefoot support area of the second ground-engaging component, and (b) a medial side forefoot edge support extending along and defining at least a portion of a medial forefoot edge of the second ground-engaging component, wherein the medial side forefoot edge support includes a bottom surface that slants in an outward and downward direction over a majority of a width of the bottom surface of the medial side forefoot edge support from the second open space to the medial forefoot edge, wherein the medial forefoot edge is an outermost medial forefoot side edge of the second ground-engaging component, wherein the medial side forefoot edge support includes a plurality of medial edge support components defining the outermost medial forefoot side edge of the second ground-engaging component, wherein the plurality of medial edge support components are defined by a plurality of gaps that are located in the bottom surface of the medial side forefoot edge support, the plurality of gaps extending to the outermost medial forefoot side edge such that the plurality of medial edge support components and the plurality of gaps together define the outermost medial forefoot side edge, wherein the second ground-engaging component defines a second longitudinal direction and a second longitudinal length L extending from a rear-most heel location of the second ground-engaging component to a forward-most toe location of the second ground-engaging component, wherein the medial side forefoot edge support terminates at a first end between planes perpendicular to the second longitudinal direction and located at 0.9L and 1.0L measured forward from the rear-most heel location of the second ground-engaging component, and wherein the medial side forefoot edge support terminates at a second end opposite the first end between planes perpendicular to the second longitudinal direction and located at 0.5L and 0.75L measured forward from the rear-most heel location of the second ground-engaging component.

17. The pair of shoes according to claim 16, wherein the first shoe is a right shoe and the second shoe is a left shoe.

18. The pair of shoes according to claim 16, wherein the first ground-engaging component extends from a medial side edge of the first shoe to a lateral side edge of the first shoe, wherein the second ground-engaging component extends from a medial side edge of the second shoe to a lateral side edge of the second shoe, wherein the bottom surface of the first ground-engaging component slants in the outward and downward direction only on the lateral forefoot edge of the first ground-engaging component, and wherein the bottom surface of the second ground-engaging component slants in the outward and downward direction only on the medial forefoot edge of the second-ground engaging component.

* * * * *